US010867556B2

(12) United States Patent
Liu et al.

(10) Patent No.: US 10,867,556 B2
(45) Date of Patent: Dec. 15, 2020

(54) PIXEL UNIT CIRCUIT, METHOD FOR DRIVING THE SAME, AND PIXEL CIRCUIT

(71) Applicant: BOE Technology Group Co., Ltd., Beijing (CN)

(72) Inventors: Yingming Liu, Beijing (CN); Xue Dong, Beijing (CN); Haisheng Wang, Beijing (CN); Xiaoliang Ding, Beijing (CN); Changfeng Li, Beijing (CN); Wei Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/197,834

(22) Filed: Nov. 21, 2018

(65) Prior Publication Data

US 2019/0164493 A1 May 30, 2019

(30) Foreign Application Priority Data

Nov. 24, 2017 (CN) ..... 2017 1 1190111

(51) Int. Cl.
*G09G 3/3258* (2016.01)

(52) U.S. Cl.
CPC ... *G09G 3/3258* (2013.01); *G09G 2300/0819* (2013.01); *G09G 2300/0842* (2013.01);
(Continued)

(58) Field of Classification Search
CPC ... G09G 2300/0819; G09G 2300/0842; G09G 2310/0297; G09G 2320/0693; G09G 2360/148
See application file for complete search history.

(56) References Cited

U.S. PATENT DOCUMENTS

2005/0128193 A1* 6/2005 Lueder ..... G09G 3/3291 345/207
2007/0115685 A1* 5/2007 Kondo ..... G09G 3/3426 362/561
(Continued)

FOREIGN PATENT DOCUMENTS

CN 103280181 A 9/2013
CN 103714777 A 4/2014
(Continued)

OTHER PUBLICATIONS

First Office Action, including Search Report, for Chinese Patent Application No. 201711190111.3, dated May 30, 2019, 17 pages.

*Primary Examiner* — Lixi C Simpson
(74) *Attorney, Agent, or Firm* — Westman, Champlin & Koehler, P.A.

(57) ABSTRACT

A pixel unit circuit, a driving method of the pixel unit circuit, and a pixel circuit are provided. The pixel unit circuit includes at least one sub-pixel sub-unit circuit connected to display signal lines and display signal terminals; and pixel compensation sub-unit circuit connected to two compensation signal lines and at least one compensation signal terminal, wherein one of the display signal lines and one of the compensation signal lines are a same signal line, and/or one of the display signal terminals and one of the at least one compensation signal terminal are a same signal terminal, and/or the pixel unit circuit further includes a multiplexer sub-circuit, one of the display signal lines is connected to a first terminal of the multiplexer sub-circuit, one of the compensation signal lines is connected to a second terminal of the multiplexer sub-circuit.

16 Claims, 12 Drawing Sheets

(52) U.S. Cl.
CPC ..... *G09G 2310/0297* (2013.01); *G09G 2320/0626* (2013.01); *G09G 2320/0693* (2013.01); *G09G 2360/148* (2013.01)

(56) References Cited

U.S. PATENT DOCUMENTS

| | | | | |
|---|---|---|---|---|
| 2008/0231562 | A1 | 9/2008 | Kwon | |
| 2010/0253706 | A1* | 10/2010 | Shirouzu ..... | G09G 3/2092 345/690 |
| 2014/0092076 | A1 | 4/2014 | Lee | |
| 2015/0123953 | A1 | 5/2015 | Shim et al. | |
| 2016/0163260 | A1* | 6/2016 | Takahashi ..... | G09G 3/3233 345/207 |
| 2017/0193906 | A1 | 7/2017 | Li et al. | |
| 2017/0206836 | A1* | 7/2017 | Kim ..... | G09G 3/3233 |
| 2020/0035159 | A1* | 1/2020 | Lin ..... | G09G 3/3225 |

FOREIGN PATENT DOCUMENTS

| | | | |
|---|---|---|---|
| CN | 104637440 | A | 5/2015 |
| CN | 105427798 | A | 3/2016 |

* cited by examiner

PIXEL UNIT CIRCUIT, METHOD FOR DRIVING THE SAME, AND PIXEL CIRCUIT

CROSS-REFERENCE TO RELATED APPLICATION

The present application claims a priority of a Chinese patent application No. 201711190111.3 filed in China on Nov. 24, 2017, a disclosure of which is incorporated herein in its entirety by reference.

TECHNICAL FIELD

The present disclosure relates to a field of a display technology, and specifically relates to a pixel unit circuit, a method for driving the pixel unit circuit, and a pixel circuit.

BACKGROUND

A relevant optical pixel compensation circuit needs more leading wires and more circuit elements while normal displaying is achieved, and is incapable of achieving a high PPI (Pixel Per Inch).

SUMMARY

A pixel unit circuit, a method for driving the pixel unit circuit, and a pixel circuit is provided.

In a first aspect, a pixel unit circuit is provided in the present disclosure, and includes at least one sub-pixel sub-unit circuit and a pixel compensation sub-unit circuit, wherein the at least one sub-pixel sub-unit circuit is connected to at least two display signal lines and at least two display signal terminals, the pixel compensation sub-unit circuit is connected to at least two compensation signal lines and at least one compensation signal terminal, and at least one of following (i), (ii), or (iii): (i) one of the at least two display signal lines and one of the at least two compensation signal lines are a same signal line, (ii) one of the at least two display signal terminals and one of the at least one compensation signal terminal are a same signal terminal, (iii) the pixel unit circuit further includes a multiplexer sub-circuit, one of the at least two display signal lines is connected to a first input terminal of the multiplexer sub-circuit, one of the at least two compensation signal lines is connected to a second input terminal of the multiplexer sub-circuit.

Optionally. each of the at least one sub-pixel sub-unit circuit includes a data writing sub-circuit, a driving transistor, and a light emitting element. The pixel compensation sub-unit circuit includes a reading control sub-circuit, and a photosensitive sub-circuit configured to convert light emitted from the light emitting element to an electric signal. The at least two display signal lines include a first gate line and a data line. The at least two display signal terminals include a first voltage input terminal and a second voltage input terminal. The at least two compensation signal lines include a second gate line and a reading line. The at least one compensation signal terminal includes a third voltage input terminal. The data writing sub-circuit is connected to the first gate line, the data line and a gate electrode of the driving transistor. A first electrode of the driving transistor is connected to the first voltage input terminal, a second electrode of the driving transistor is connected to a first electrode of the light emitting element, and a second electrode of the light emitting element is connected to the second voltage input terminal. The reading control sub-circuit is connected to the second gate line, the reading line and a first terminal of the photosensitive sub-circuit. A second terminal of the photosensitive sub-circuit is connected to the third voltage input terminal.

Optionally, the pixel compensation sub-unit circuit further includes a compensation control sub-circuit. The compensation control sub-circuit is connected to the reading line and is connected to a data driving sub-circuit connected to the data line. The compensation control sub-circuit is configured to read an electrical signal in the reading line, compare a value of the electrical signal with a pre-determined electrical signal value, determine whether a voltage in the data line needs to be adjusted or not according to a result of the comparison; and in case that the voltage in the data line needs to be adjusted, the compensation control sub-circuit is configured to send a data voltage adjustment signal to the data driving sub-circuit so that the data driving sub-circuit obtains the data voltage adjustment signal. The data driving sub-circuit is configured to adjust a data voltage to be outputted to the data line according the data voltage adjustment signal and obtain an adjusted data voltage, and send the adjusted data voltage to the at least one sub-pixel sub-circuit through the data line.

Optionally, the second voltage input terminal and the third voltage input terminal are a same voltage input terminal. Both the second voltage input terminal and the third voltage input terminal are low voltage input terminals. The photosensitive sub-circuit includes a photosensitive diode, an anode of the photosensitive diode is connected to the third voltage input terminal, and a cathode of the photosensitive diode is connected to the reading control sub-circuit.

Optionally, the first voltage input terminal and the third voltage input terminal are a same voltage input terminal. Both the first voltage input terminal and the third voltage input terminal are high voltage input terminals. The photosensitive sub-circuit includes a photosensitive diode, a cathode of the photosensitive diode is connected to the third voltage input terminal, and an anode of the photosensitive diode is connected to the reading control sub-circuit.

Optionally, the first gate line and the second gate line are a same gate line.

Optionally, the pixel unit circuit further includes a multiplexer sub-circuit; wherein the data line is connected to a first input terminal of the multiplexer sub-circuit, the reading line is connected to a second input terminal of the multiplexer sub-circuit, and an output terminal of the multiplexer sub-circuit is connected to a control circuit outside the pixel unit circuit.

Optionally, a quantity of the at least one sub-pixel sub-unit circuit included in the pixel unit circuit is at least two. The pixel unit circuit further includes a display control sub-circuit. The display control sub-circuit is configured to control the at least two sub-pixel sub-unit circuits included in the pixel unit circuit to emit light at different time periods.

Optionally, the data writing sub-circuit includes a first transistor and a capacitor, a gate electrode of the first transistor is connected to the first gate line, a first electrode of the first transistor is connected to the data line, a second electrode of the first transistor is connected to a gate electrode of the driving transistor; a first electrode plate of the capacitor is connected to the gate electrode of the driving transistor, and a second electrode plate of the capacitor is connected to the second electrode of the driving transistor. The reading control sub-circuit includes a second transistor, a gate electrode of the second transistor is connected to the second gate line, a first electrode of the second transistor is connected to the reading line, a second electrode of the second transistor is connected to the first electrode of the photosensitive sub-circuit.

In a second aspect, A pixel circuit is provided in the present disclosure, and includes: a plurality of pixel unit circuits according to the first aspect, wherein the plurality of pixel unit circuits is arranged in a matrix including multiple rows and multiple columns.

Optionally, the at least two compensation signal lines include a second gate line and a reading line. Pixel compensation sub-unit circuits included in a same row of the multiple rows of pixel unit circuits in the plurality of pixel unit circuits are connected to a same second gate line; and pixel compensation sub-unit circuits included in a same column of the multiple columns of pixel unit circuits in the plurality of pixel unit circuits are connected to a same reading line.

In a third aspect, a pixel circuit is provided in the present disclosure and includes a plurality of pixel unit circuits according to the first aspect, wherein each of the at least one sub-pixel sub-unit circuit includes a data writing sub-circuit, a driving transistor, and a light emitting element; the pixel compensation sub-unit circuit includes a reading control sub-circuit and a photosensitive sub-circuit configured to convert light emitted from the light emitting element to an electric signal; the at least two display signal lines include a first gate line and a data line; the at least two display signal terminals include a first voltage input terminal and a second voltage input terminal; the at least two compensation signal lines include a second gate line and a reading line; the at least one compensation signal terminal includes a third voltage input terminal; the data writing sub-circuit is connected to the first gate line, the data line and a gate electrode of the driving transistor; a first electrode of the driving transistor is connected to the first voltage input terminal, a second electrode of the driving transistor is connected to a first electrode of the light emitting element, and a second electrode of the light emitting element is connected to the second voltage input terminal; the reading control sub-circuit is connected to the second gate line, the reading line and a first terminal of the photosensitive sub-circuit; a second terminal of the photosensitive sub-circuit is connected to the third voltage input terminal. The pixel unit circuit further includes a multiplexer sub-circuit; wherein the data line is connected to a first input terminal of the multiplexer sub-circuit, the reading line is connected to a second input terminal of the multiplexer sub-circuit, and an output terminal of the multiplexer sub-circuit is connected to a control circuit outside the pixel unit circuit. The plurality of pixel unit circuits is arranged in a matrix including multiple rows and multiple columns; and the control circuit includes a compensation control sub-circuit and a data driving sub-circuit connected to the compensation control sub-circuit; wherein the compensation control sub-circuit is connected to the reading line through the multiplexer sub-circuit, the data driving sub-circuit is connected to the data line through the multiplexer sub-circuit; the compensation control sub-circuit is configured to read an electrical signal in the reading line, compare a value of the electrical signal with a pre-determined electrical signal value, determine whether a voltage in the data line needs to be adjusted or not according to a result of the comparison; and in case that the voltage in the data line needs to be adjusted, the compensation control sub-circuit is configured to send a data voltage adjustment signal to the data driving sub-circuit so that the data driving sub-circuit obtains the data voltage adjustment signal; the data driving sub-circuit is configured to adjust a data voltage to be outputted to the data line according the data voltage adjustment signal and obtain an adjusted data voltage, and send the adjusted data voltage to the at least one sub-pixel sub-circuit.

In a fourth aspect, a method for driving the pixel unit circuit according to the first aspect is provided, wherein in the pixel unit circuit, each of the at least one sub-pixel sub-unit circuit included in the pixel unit circuit includes a light emitting element, the pixel compensation sub-unit circuit includes a reading control sub-circuit and a photosensitive sub-circuit configured to convert light emitted by the light emitting element to an electrical signal; a compensation control sub-circuit is connected to a data driving sub-circuit, the data driving sub-circuit is configured to supply a data voltage to a data line connected to each of the at least one sub-pixel sub-unit circuit; wherein a compensation time stage is provided between two display time stages, the compensation time stage includes a reading time sub-stage corresponding to the pixel compensation sub-unit circuit. the method includes: obtaining a predetermined brightness corresponding to a predetermined data voltage according to a gamma curve of the at least one sub-pixel sub-unit circuit, and converting the predetermined brightness to a predetermined electrical signal value according to photoelectric conversion parameters of the photosensitive sub-circuit; sensing, by the photosensitive circuit, light emitted from the light emitting element in the sub-pixel sub-unit circuit, and converting the light to an electrical signal corresponding to the light; in the reading time sub-stage, controlling, by the reading control sub-circuit, the photosensitive sub-circuit to be connected to the reading line so that the electrical signal is transferred from the photosensitive sub-circuit to the compensation control sub-circuit through the reading line; detecting, by the compensation control sub-circuit, a value of the electrical signal, comparing the value of the electrical signal with the predetermined electrical signal value, determining whether a data voltage in the data line needs to be adjusted or not according to a result of the comparison; and in case that the data voltage in the data line needs to be adjusted, sending, by the compensation control sub-circuit, a data voltage adjustment signal to the data driving sub-circuit so that the data driving sub-circuit adjusts the data voltage to be outputted to the data line and obtains an adjusted data voltage; and transmitting, by the data driving sub-circuit through the data line, the adjusted data voltage to one of the at least one sub-pixel sub-unit circuit connected to the data line.

Optionally, the electrical signal includes at least one of an electrical voltage signal, an electrical current signal or an electric charge signal; the value of the electrical signal includes at least one of an electrical voltage value, an electrical current value or an electric charge amount.

Optionally, each of the at least one sub-pixel sub-unit circuit further includes a data writing sub-pixel and a driving transistor; the at least two display signal lines include a first gate line and a data line; the at least two compensation signal lines include a second gate line and a reading line; the data writing sub-circuit is connected to the first gate line, the data line and a gate electrode of the driving transistor; the reading control sub-circuit is connected to the second gate line, the reading line and a first terminal of the photosensitive sub-circuit; the first gate line and the second gate line are a same gate line; the method further includes: in one of the display time stages in which a voltage in the reading line is a low level, controlling, by the data writing sub-circuit under a control of the first gate line, a data voltage in the data line to be written into the gate electrode of the driving transistor, and controlling, by the reading control sub-circuit, the first terminal of the photosensitive sub-circuit to be connected to the reading line so that an electrical potential of the first terminal of the photosensitive sub-circuit is reset; in the reading time sub-stage after the display time stage, controlling, by the reading control sub-circuit, the photosensitive sub-circuit to be connected to the reading line so that the electrical signal is transferred from the photosensitive sub-circuit to the compensation control sub-circuit through the reading line.

Optionally, in the reading time sub-stage after the display time stage, controlling, by the reading control sub-circuit, the photosensitive sub-circuit to be connected to the reading line so that the electrical signal is transferred from photosensitive sub-circuit to the compensation control sub-circuit through the reading line, specifically includes: in the reading time sub-stage, controlling, by the reading control sub-circuit, a first terminal of the photosensitive sub-circuit to be connected to the reading line so that the electrical signal is transferred from the photosensitive sub-circuit to the compensation control sub-circuit through the reading line.

Optionally, the at least one sub-pixel sub-unit circuit further includes a data writing sub-circuit and a driving transistor; the at least two display signal lines include a first gate line and the data line; the at least two compensation signal lines include a second gate line and the reading line; the data writing sub-circuit is connected to the first gate line, the data line and a gate electrode of the driving transistor; the reading control sub-circuit is connected to the second gate line, the reading line and a first terminal of the photosensitive circuit; the pixel unit circuit includes a multiplexer circuit; the data line is connected to a first input terminal of the multiplexer sub-circuit; the reading line is connected to a second input terminal of the multiplexer sub-circuit; an output terminal of the multiplexer sub-circuit is connected to a control circuit outside the pixel unit circuit; the compensation control sub-circuit and the data driving sub-circuit are arranged in the control circuit; the compensation control sub-circuit is connected to the reading line through the multiplexer sub-circuit; in the reading time sub-stage, controlling, by the reading control sub-circuit, the photosensitive sub-circuit to be connected to the reading line so that the electrical signal is transferred from the photosensitive sub-circuit to the compensation control sub-circuit through the reading line, includes: in the reading time sub-stage, controlling, by the multiplexer sub-circuit, the reading line to be connected to the control circuit, so that the electrical signal is transferred from the photosensitive sub-circuit to the compensation control sub-circuit in the control circuit through the reading line. After the data driving sub-circuit obtains the adjusted data voltage, the method further includes: controlling, by the multiplexer sub-circuit, the reading line and the control circuit to be disconnected with each other, and controlling, by the multiplexer sub-circuit, the control circuit and the data line to be connected to each other, and transmitting, by the data driving sub-circuit, the adjusted data voltage to the at least one sub-pixel sub-unit circuit through the data line.

DETAILED DESCRIPTION

Figure 1:
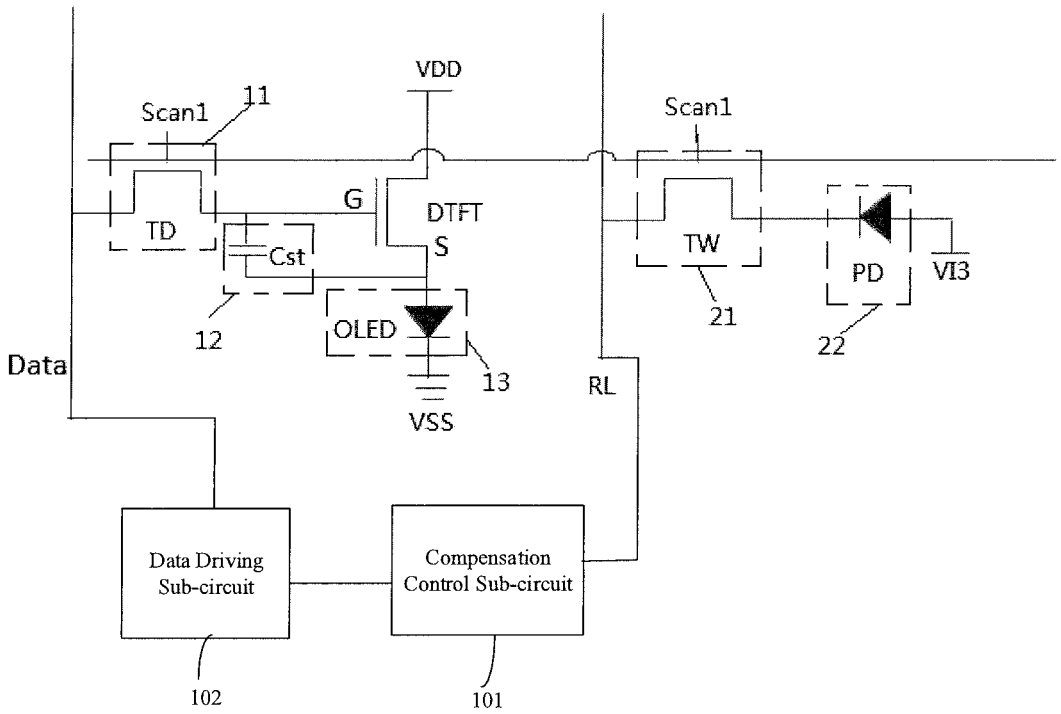
FIG. 1 is a circuit diagram of a first example of a pixel unit circuit according to the present disclosure.

Technical solutions of some embodiments of the present disclosure will be described clearly and completely hereinafter in conjunction with drawings of the embodiments in the present disclosure. Obviously, the described embodiments are only part, but not all, of the embodiments of the present disclosure. All other embodiments obtained by one skilled in the art without paying any creative labor based on the embodiments of the present disclosure fall into the scope of the present disclosure.

All transistors described in the embodiments of the present disclosure may be thin-film transistors or field effect transistors or other devices having similar characteristics. In the embodiments of the present disclosure, in order to differentiate two electrodes other than the gate electrode of a transistor, one of the two electrodes is called as a first electrode, and the other of the two electrodes is called as a second electrode. In actual applications, the first electrode may be a drain electrode, the second electrode may be a source electrode; or, the first electrode may be the source electrode, and the second electrode may be the drain electrode.

The present disclosure provides a pixel unit circuit, a method for driving the pixel unit circuit, and a pixel circuit. The pixel unit circuit, the method for driving the pixel unit circuit and the pixel circuit may reduce a quantity of leading wires and a quantity of circuit elements while normal displaying is implemented, thereby facilitating manufacturing a product of a high PPI.

The pixel unit circuit according to some embodiments of the present disclosure includes a sub-pixel sub-unit circuit and a pixel compensation sub-unit circuit. The sub-pixel sub-unit circuit is connected to at least two display signal lines and at least two display signal terminals. The pixel compensation sub-unit circuit is connected to at least two compensation signal lines and at least one compensation signal terminals.

One of the display signal lines and one of the compensation signal lines are a same signal line; and/or, one of the display signal terminals and one of the compensation signal terminals are a same signal terminal; and/or the pixel unit circuit further includes a multiplexer sub-circuit. The multiplexer sub-circuit at least includes a first input terminal, a second input terminal and an output terminal. One of the display signal lines is connected to the first input terminal of the multiplexer sub-circuit, one of the compensation signal lines is connected to the second input terminal of the multiplexer sub-circuit, and the output terminal of the multiplexer sub-circuit is connected to a control circuit outside the pixel unit circuit.

Optionally, a compensation control sub-circuit and a data driving sub-circuit are arranged in the control circuit outside the pixel unit circuit. The compensation control sub-circuit and the data driving sub-circuit mentioned in the present disclosure are known for one skilled in the art, which are used to compensate brightness of light emitted from the sub-pixel sub-unit circuit and to drive data lines, respectively. Structures of the compensation control sub-circuit and the data driving sub-circuit are known for one skilled in the art.

Optionally, the output terminal of the multiplexer sub-circuit mentioned in the present disclosure may be an input terminal, and the first input terminal and the second input terminal may also be output terminals, i.e., an input terminal and an output terminal of the multiplexer sub-circuit are interchangeable according to actual conditions.

In the pixel unit circuit mentioned in some embodiments of the present disclosure, signal lines are re-used, signal terminals are re-used, or the display signal line and the compensation signal line are selected by the multiplexer sub-circuit so that the display signal line and the compensation signal line are connected to the control circuit outside the pixel unit circuit at different time stages. Thus, a quantity of leading wires and a quantity of signal terminals may be reduced while implementing normal displaying, and a design of the pixel unit circuit is optimized, thereby facilitating manufacturing a product of a high PPI.

Specifically, the sub-pixel sub-unit circuit includes a data writing sub-circuit, a driving transistor, and a light emitting element. The pixel compensation sub-unit circuit includes a reading control sub-circuit and a photosensitive sub-circuit. The photosensitive sub-circuit is configured to convert light emitted from the light emitting element to an electric signal.

The at least two display signal lines may include a first gate line and a data line; the at least two display signal terminals may include a first voltage input terminal and a second voltage input terminal. The at least two compensation signal lines may include a second gate line and a reading line. The plurality of compensation signal terminals may include a third voltage input terminal.

The data writing sub-circuit is connected to the first gate line, the data line and a gate electrode of the driving transistor. A first electrode of the driving transistor is connected to the first voltage input terminal, a second electrode of the driving transistor is connected to a first electrode of the light emitting element, and a second electrode of the light emitting element is connected to the second voltage input terminal.

The reading control sub-circuit is connected to the second gate line, the reading line and a first terminal of the photosensitive sub-circuit. A second terminal of the photosensitive sub-circuit is connected to the third voltage input terminal.

The pixel compensation sub-unit circuit may further include a compensation control sub-circuit.

Optionally, the compensation control sub-circuit may be arranged in the control circuit outside the pixel unit circuit.

In actual operation, the light emitting element may include an Organic Light Emitting Diode (OLED). In such a case, the first electrode of the light emitting element is an anode of the OLED, and the second electrode of the light-emitting element is a cathode of the OLED.

In actual operation, the first voltage input terminal may be a high-voltage input terminal, and the second voltage input terminal may be a low-voltage input terminal, but the present disclosure is not limited thereto. A high voltage and a low voltage in the present disclosure refer to two voltages have different values relative to each other. The high voltage and the low voltage may be any voltages applicable to technical solutions of the present disclosure, and a value of the high voltage is higher than that of the low voltage. However, values of the high voltage and the low voltage are not specifically defined in the present disclosure.

In actual operation, the compensation control sub-circuit is connected to the reading line, and is configured to read an electrical signal in the reading line, compare a value of the electrical signal with a pre-determined electrical signal value, determine whether a data voltage in the data line needs to be adjusted or not according to a result of the comparison. In case that the data voltage in the data line needs to be adjusted, the compensation control sub-circuit sends a data voltage adjustment signal to a data driving sub-circuit connected to the data line in the pixel unit circuit so that the data driving sub-circuit may obtain the data voltage adjustment signal.

The data driving sub-circuit is configured to adjust a data voltage to be outputted to the data line according the data voltage adjustment signal and obtains an adjusted data voltage, and sends the adjusted data voltage to the at least one sub-pixel sub-unit circuit.

Optionally, the first gate line and the second gate line may be the same gate line.

Optionally, the second voltage input terminal and the third voltage input terminal may be the same voltage input terminal.

Optionally, both the second voltage input terminal and the third voltage input terminal may be low-voltage input terminals. The photosensitive sub-circuit may include a photosensitive diode. An anode of the photosensitive diode is connected to the third voltage input terminal, and a cathode of the photosensitive diode is connected to the reading control sub-circuit.

Optionally, the first voltage input terminal and the third voltage input terminal may be the same voltage input terminal.

Optionally, both the first voltage input terminal and the third voltage input terminal may be high-voltage input terminals. The photosensitive sub-circuit may include the photosensitive diode. The cathode of the photosensitive diode is connected to the third voltage input terminal, and the anode of the photosensitive diode is connected to the reading control sub-circuit.

Optionally, the pixel unit circuit provided in some embodiments of the present disclosure may include a multiplexer sub-circuit. The multiplexer sub-circuit at least includes a first input terminal, a second input terminal and an output terminal. The data line is connected to the first input terminal of the multiplexer sub-circuit, the reading line is connected to the second input terminal of the multiplexer sub-circuit, and the output terminal of the multiplexer sub-circuit is connected to the control circuit outside the pixel unit circuit.

The pixel unit circuit of the present disclosure will be described hereinafter by way of specific examples.

As shown in FIG. 1, a first example of the pixel unit circuit according to the present disclosure includes a sub-pixel sub-unit circuit and a pixel compensation sub-unit circuit.

The sub-pixel sub-unit circuit includes a data writing sub-circuit 11, a storage capacitor sub-circuit 12, a driving transistor DTFT and a light emitting element 13. The sub-pixel sub-unit circuit is connected to at least two display signal lines and at least two display signal terminals. The pixel compensation sub-unit circuit includes a reading control sub-circuit 21 and a photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data. The at least two display signal terminals may include a first voltage input terminal and a second voltage input terminal. The at least two compensation signal lines may include a second gate line and a reading line RL. The compensation signal terminal may include a third voltage input terminal VI3.

The pixel compensation sub-unit circuit may further include a compensation control sub-circuit 101. The compensation control sub-circuit 101 is connected to the reading line RL, and is connected to a data driving sub-circuit 102 connected to the data line Data.

In the first example of the pixel unit circuit provided in the present disclosure, the second gate line and the first gate line Scan1 are the same gate line.

In the first example of the pixel unit circuit as shown in FIG. 1 of the present disclosure, the first voltage input terminal is a high-voltage input terminal inputted with a high voltage VDD, the second voltage input terminal is a low-voltage input terminal inputted with a low voltage VSS, and the light emitting element 13 includes an organic light emitting diode OLED.

The data writing sub-circuit 11 includes a data writing transistor TD. A gate electrode of the data writing transistor TD is connected to the first gate line Scan1, a drain electrode of the data writing transistor TD is connected to the data line Data, and a source electrode of the data writing transistor TD is connected to a gate electrode G of the driving transistor DTFT. A drain electrode of the driving transistor DTFT is connected to the high-voltage input terminal inputted with the high voltage VDD. A source electrode S of the driving transistor DTFT is connected to an anode of the organic light emitting diode OLED.

A cathode of the organic light emitting diode OLED is connected to the low-voltage input terminal inputted with the low voltage VSS.

The storage capacitor sub-circuit 12 includes a storage capacitor Cst. A first electrode plate of the storage capacitor Cst is connected to a gate electrode G of the driving transistor DTFT. A second electrode plate of the storage capacitor Cst is connected to the source electrode S of the driving transistor DTFT.

In the first example of the pixel unit circuit as shown in FIG. 1 of the present disclosure, the photosensitive sub-circuit 22 includes a photosensitive diode PD.

The reading control sub-circuit 21 includes a reading control transistor TW. A gate electrode of the reading control transistor TW is connected to the first gate line Scan1, a drain electrode of the reading control transistor TW is connected to a cathode of the photosensitive diode PD, and a source electrode of the reading control transistor TW is connected to the reading line RL.

An anode of the photosensitive diode PD is connected to the third voltage input terminal VI3. In the first example, the third voltage input terminal VI3 may be a low-voltage input terminal inputted with a low voltage.

In the first example as shown in FIG. 1 of the present disclosure, both TD and TW may be n-type transistors. However, in actual conditions, the TD and the TW may also be P-type transistors. Types of the transistors are not specifically limited herein.

When the pixel compensation sub-unit circuit as shown in FIG. 1 of the present disclosure operates, the pixel compensation sub-unit circuit performs operations as follow.

Firstly, a high voltage is inputted on the gate line Scan1, and the transistor TD is turned on, and a data voltage in the data line Data is written into the gate electrode of the transistor DTFT. In the meanwhile, the transistor TW is turned on, and an electrical potential of the cathode of the photosensitive diode PD is reset.

Then, a low voltage is inputted on the gate line Scan1, the organic light emitting diode OLED emits light, and the light emitted from the OLED is irradiated on the photosensitive diode PD. The photosensitive diode PD converts the light to an electrical signal corresponding to the light.

After integration time passed, the high voltage is inputted again on the gate line Scan1, the transistor TW is turned on, so that the electrical signal is transferred to the reading line RL through the turned-on transistor TW. The electrical signal transferred to the reading line RL is associated with brightness of the light emitted from the OLED within the integration time. The compensation control sub-circuit 101 reads the electrical signal on the reading line RL, compares a value of the electrical signal with a pre-determined electrical signal value, determines whether the data voltage needs to be compensated or not according to a result of the comparison. In case that the compensation control sub-circuit 101 determines that the data voltage needs to be compensated, the compensation control sub-circuit sends a data voltage adjustment signal to the data driving sub-circuit. The data driving sub-circuit 102 adjusts the data voltage to be outputted to the data line according to the data voltage adjustment signal and obtains the adjusted data voltage. Then, the data driving sub-circuit 102 sends the adjusted data voltage to the data line Data.

In the first example of the pixel unit circuit as shown in FIG. 1 of the present disclosure, the first gate line and the second gate line are the same gate line. Thus, a quantity of leading wires may be reduced.

Figure 2:
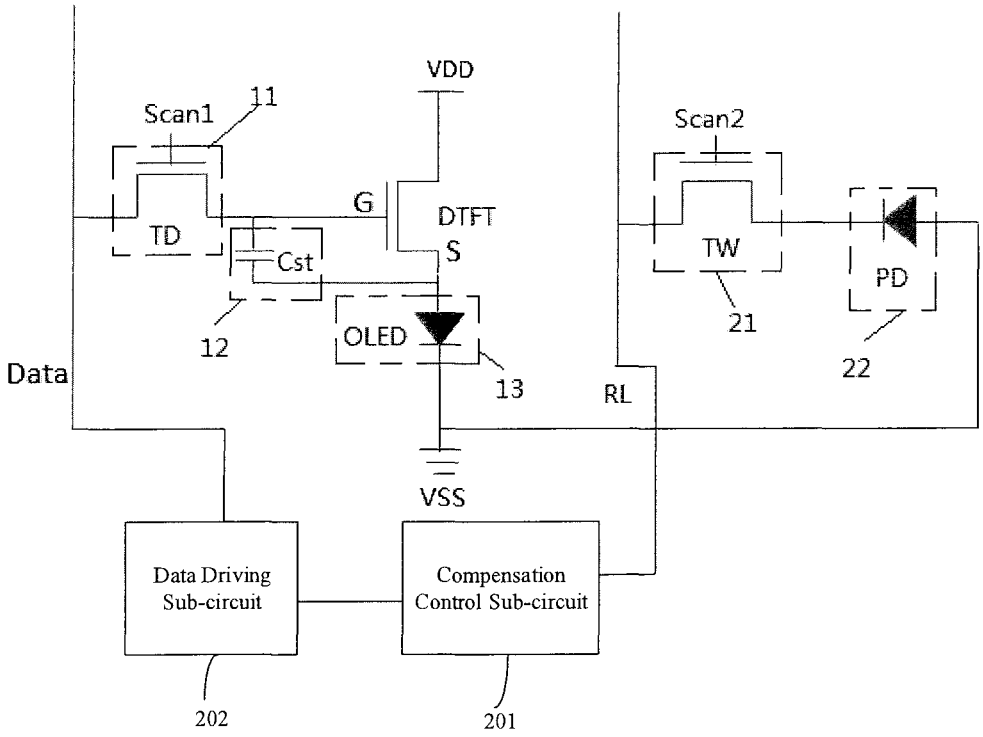
FIG. 2 is a circuit diagram of a second example of a pixel unit circuit according to the present disclosure.

As shown in FIG. 2, a second example of the pixel unit circuit according to the present disclosure includes a sub-pixel sub-unit circuit and a pixel compensation sub-unit circuit.

The sub-pixel sub-unit circuit includes a data writing sub-circuit 11, a storage capacitor sub-circuit 12, a driving transistor DTFT and a light emitting element 13. The sub-pixel sub-unit circuit is connected to at least two display signal lines and at least two display signal terminals.

The pixel compensation sub-unit circuit includes a reading control sub-circuit 21 and a photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data. The at least two display signal terminals may include a first voltage input terminal and a second voltage input terminal. The at least two compensation signal lines may include a second gate line and a reading line RL. The plurality of compensation signal terminals may include a third voltage input terminal.

The pixel compensation sub-unit circuit may further include a compensation control sub-circuit 201. The compensation control sub-circuit 201 is connected to the reading line RL, and is connected to a data driving sub-circuit 202 connected to the data line Data.

In the second example of the pixel unit circuit as shown in FIG. 2 of the present disclosure, the first voltage input terminal is a high-voltage input terminal inputted with a high voltage VDD. The second voltage input terminal is a low-voltage input terminal inputted with a low voltage VSS. The light emitting element 13 includes an organic light emitting diode OLED.

In the second example of the pixel unit circuit of the present disclosure, the third voltage input terminal and a low-voltage input terminal inputted with a low voltage VSS are the same voltage input terminal.

The data writing sub-circuit 11 includes a data writing transistor TD. A gate electrode of the data writing transistor TD is connected to the first gate line Scan1, a drain electrode of the data writing transistor TD is connected to the data line Data, and a source electrode of the data writing transistor TD is connected to a gate electrode G of the driving transistor DTFT.

A drain electrode of the driving transistor DTFT is connected to the high-voltage input terminal inputted with the high voltage VDD. A source electrode S of the driving transistor DTFT is connected to an anode of the organic light emitting diode OLED.

A cathode of the organic light emitting diode OLED is connected to the low-voltage input terminal inputted with the low voltage VSS.

The storage capacitor sub-circuit 12 includes a storage capacitor Cst. A first electrode plate of the storage capacitor Cst is connected to the gate electrode G of the driving transistor DTFT. A second electrode plate of the storage capacitor Cst is connected to the source electrode S of the driving transistor DTFT.

In the second example of the pixel unit circuit as shown in FIG. 2 of the present disclosure, the photosensitive sub-circuit 22 includes a photosensitive diode PD.

The reading control sub-circuit 21 includes a reading control transistor TW. A gate electrode of the reading control transistor TW is connected to the second gate line Scan2, a drain electrode of the reading control transistor TW is connected to a cathode of the photosensitive diode PD, and a source electrode of the reading control transistor TW is connected to the reading line RL.

An anode of the photosensitive diode PD is connected to the low-voltage input terminal inputted with the low voltage VSS.

In the second example as shown in FIG. 2 of the present disclosure, both TD and TW may be n-type transistors. However, in actual conditions, the TD and the TW may also be P-type transistors. Types of the transistors are not specifically limited herein.

In the second example shown in FIG. 2, the cathode of the OLED and the anode of the PD are connected to the same voltage input terminal, so that a quantity of signal terminals is reduced and a quantity of leading wires is reduced.

Figure 3:
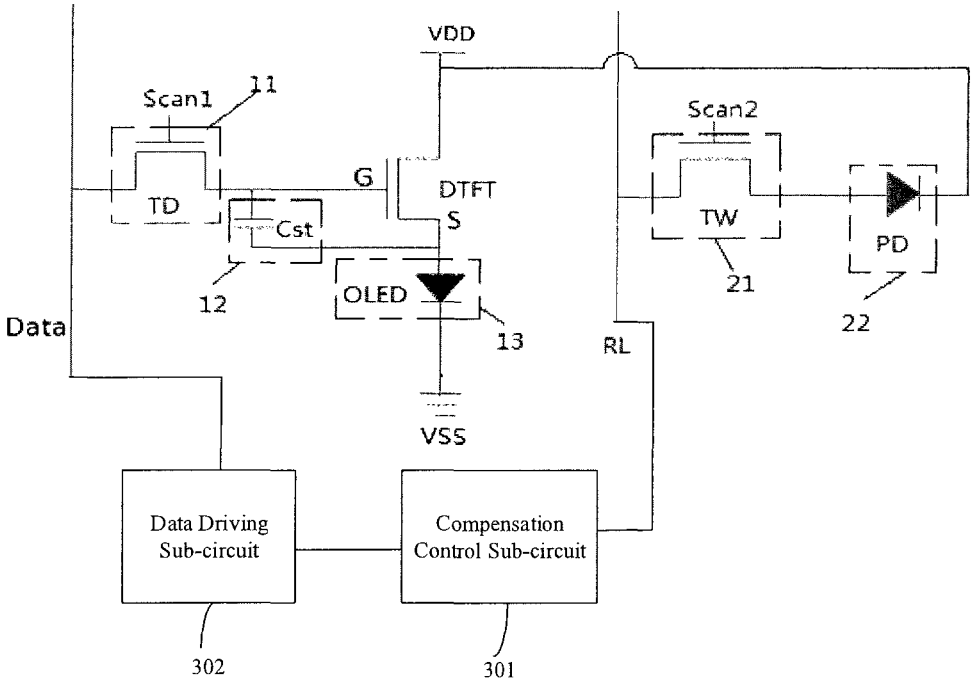
FIG. 3 is a circuit diagram of a third example of a pixel unit circuit according to the present disclosure.

As shown in FIG. 3, a third example of the pixel unit circuit according to the present disclosure includes a sub-pixel sub-unit circuit and a pixel compensation sub-unit circuit.

The sub-pixel sub-unit circuit includes a data writing sub-circuit 11, a storage capacitor sub-circuit 12, a driving transistor DTFT and a light emitting element 13. The sub-pixel sub-unit circuit is connected to at least two display signal lines and at least two display signal terminals.

The pixel compensation sub-unit circuit includes a reading control sub-circuit 21 and a photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data; the at least two display signal terminals may include a first voltage input terminal and a second voltage input terminal. The at least two compensation signal lines may include a second gate line and a reading line RL. The plurality of compensation signal terminals may include a third voltage input terminal.

The pixel compensation sub-unit circuit may further include a compensation control sub-circuit 301. The compensation control sub-circuit 101 is connected to the reading line RL, and is connected to a data driving sub-circuit 302 connected to the data line Data.

In the third example of the pixel unit circuit as shown in FIG. 3 of the present disclosure, the first voltage input terminal is a high-voltage input terminal inputted with a high voltage VDD. The second voltage input terminal is a low-voltage input terminal inputted with a low voltage VSS. The light emitting element 13 includes an organic light emitting diode OLED.

In the third example of the pixel unit circuit of the present disclosure, the third voltage input terminal and the high-voltage input terminal inputted with the high voltage VDD are the same voltage input terminal.

The data writing sub-circuit 11 includes a data writing transistor TD. A gate electrode of the data writing transistor TD is connected to the first gate line Scan1, a drain electrode of the data writing transistor TD is connected to the data line Data, and a source electrode of the data writing transistor TD is connected to a gate electrode G of the driving transistor DTFT.

A drain electrode of the driving transistor DTFT is connected to the high-voltage input terminal inputted with the high voltage VDD. A source electrode S of the driving transistor DTFT is connected to an anode of the organic light emitting diode OLED.

A cathode of the organic light emitting diode OLED is connected to the low-voltage input terminal inputted with the low voltage VSS.

The storage capacitor sub-circuit 12 includes a storage capacitor Cst. A first electrode plate of the storage capacitor Cst is connected to the gate electrode G of the driving transistor DTFT. A second electrode plate of the storage capacitor Cst is connected to the source electrode S of the driving transistor DTFT.

In the third example of the pixel unit circuit as shown in FIG. 3 of the present disclosure, the photosensitive sub-circuit 22 includes a photosensitive diode PD.

The reading control sub-circuit 21 includes a reading control transistor TW. A gate electrode of the reading control transistor TW is connected to the second gate line Scan2, a drain electrode of the reading control transistor TW is connected to an anode of the photosensitive diode PD, and a source electrode of the reading control transistor is connected to the reading line RL.

A cathode of the photosensitive diode PD is connected to the high-voltage input terminal inputted with the high voltage VDD.

In the third example as shown in FIG. 3 of the present disclosure, both TD and TW may be n-type transistors. However, in actual conditions, the TD and the TW may also be P-type transistors. Types of the transistors are not specifically limited herein.

In the third example shown in FIG. 3, the drain electrode of the DTFT and the cathode of the PD are connected to the same voltage input terminal, so that a quantity of signal terminals is reduced and a quantity of leading wires is reduced.

In actual operations, because photo-electric conversion may only be achieved when a photosensitive diode PD is in a reverse bias state, a direction of a PIN junction of the PD in the example shown in FIG. 3 is manufactured to be reverse to that of PIN junctions of the PDs shown in FIG. 1 and FIG. 2.

Figure 4:
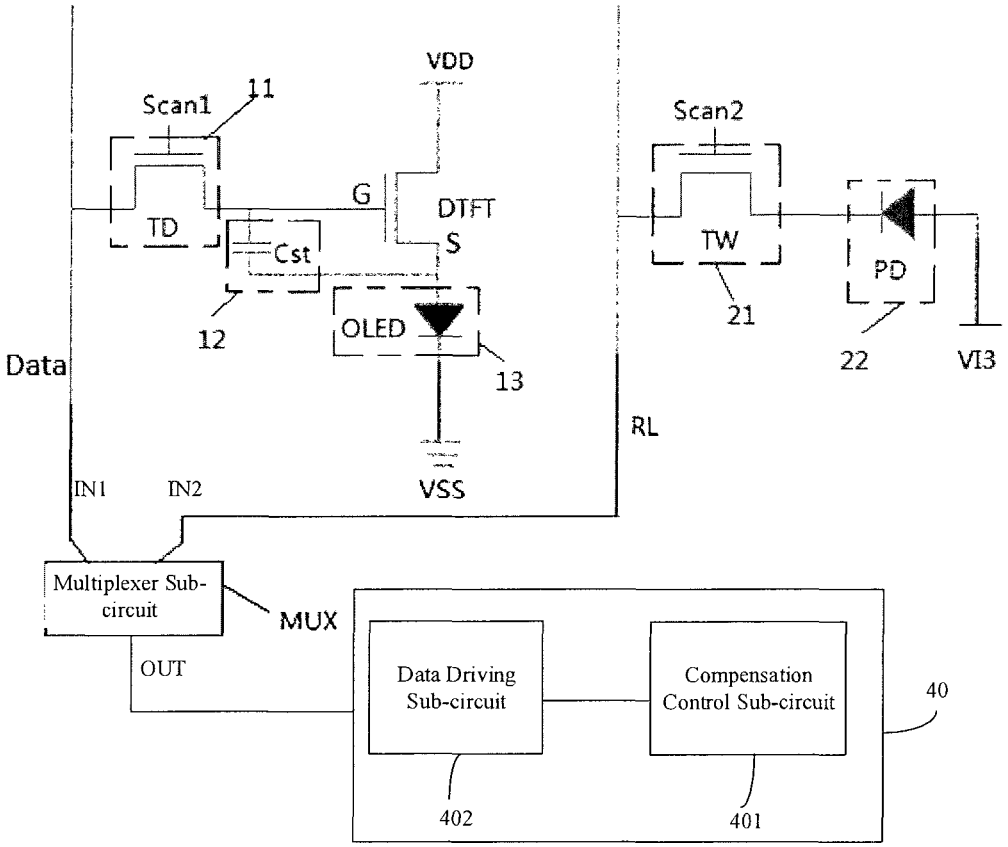
FIG. 4 is a circuit diagram of a fourth example of a pixel unit circuit according to the present disclosure.

As shown in FIG. 4, a fourth example of the pixel unit circuit according to the present disclosure includes a pixel compensation sub-unit circuit, a sub-pixel sub-unit circuit and a multiplexer sub-circuit MUX.

The sub-pixel sub-unit circuit includes a data writing sub-circuit 11, a storage capacitor sub-circuit 12, a driving transistor DTFT and a light emitting element 13. The sub-pixel sub-unit circuit is connected to at least two display signal lines and at least two display signal terminals.

The pixel compensation sub-unit circuit includes a reading control sub-circuit 21 and a photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data. The at least two display signal terminals may include a first voltage input terminal and a second voltage input terminal. The at least two compensation signal lines may include a second gate line Scan2 and a reading line RL. The plurality of compensation signal terminals may include a third voltage input terminal VI3.

In the fourth example of the pixel unit circuit as shown in FIG. 4 of the present disclosure, the first voltage input terminal is a high-voltage input terminal inputted with a high voltage VDD. The second voltage input terminal is a low-voltage input terminal inputted with a low voltage VSS. The light emitting element 13 includes an organic light emitting diode OLED.

The data writing sub-circuit 11 includes a data writing transistor TD. A gate electrode of the data writing transistor TD is connected to the first gate line Scan1, a drain electrode of the data writing transistor TD is connected to the data line Data, and a source electrode of the data writing transistor TD is connected to a gate electrode G of the driving transistor DTFT.

A drain electrode of the driving transistor DTFT is connected to the high-voltage input terminal inputted with the high voltage VDD. A source electrode S of the driving transistor DTFT is connected to an anode of the organic light emitting diode OLED.

A cathode of the organic light emitting diode OLED is connected to the low-voltage input terminal inputted with the low voltage VSS.

The storage capacitor sub-circuit 12 includes a storage capacitor Cst. A first electrode plate of the storage capacitor Cst is connected to the gate electrode G of the driving transistor DTFT. A second electrode plate of the storage capacitor Cst is connected to the source electrode S of the driving transistor DTFT.

In the fourth example of the pixel unit circuit as shown in FIG. 4 of the present disclosure, the photosensitive sub-circuit 22 includes a photosensitive diode PD.

The reading control sub-circuit 21 includes a reading control transistor TW. A gate electrode of the reading control transistor TW is connected to the second gate line Scan2, a drain electrode of the reading control transistor TW is connected to a cathode of the photosensitive diode PD, and a source electrode of the reading control transistor TW is connected to the reading line RL.

An anode of the photosensitive diode PD is connected to the third voltage input terminal VI3. In the fourth example, the third voltage input terminal VI3 may be a low-voltage input terminal inputted with a low voltage.

The data line Data is connected to a first input terminal IN1 of the multiplexer sub-circuit MUX. The reading line RL is connected to a second input terminal IN2 of the multiplexer sub-circuit MUX, and an output terminal OUT of the multiplexer sub-circuit MUX is connected to the control circuit 40 outside the pixel unit circuit.

In the fourth example as shown in FIG. 4 of the present disclosure, both TD and TW may be n-type transistors. However, in actual conditions, the TD and the TW may also be P-type transistors. Types of the transistors are not specifically limited herein.

In actual operations, in the fourth example shown in FIG. 4, the control circuit 40 is configured with a compensation control sub-circuit 401 and a data driving sub-circuit 402. The compensation control sub-circuit 401 is connectable to the reading line RL through the multiplexer sub-circuit MUX. The data driving sub-circuit 402 is connectable to the data line Data through the multiplexer sub-circuit MUX.

In a reading time stage, the multiplexer sub-circuit MUX controls the reading line RL and the control circuit 40 to be connected to each other. The electrical signal is transferred from the photosensitive diode PD to the compensation control sub-circuit in the control circuit 40 through the reading line RL.

The compensation control sub-circuit detects a value of the electrical signal, compares the value of the electrical signal with a pre-determined electrical signal value, determine whether the data voltage in the data line needs to be adjusted or not according to a result of the comparison. In case that the data voltage in the data line needs to be adjusted, the compensation control sub-circuit sends a data voltage adjustment signal to the data driving sub-circuit so that the data driving sub-circuit adjusts the data voltage to be outputted to the data line and obtains an adjusted data voltage.

After the data driving sub-circuit obtains the adjusted data voltage, the multiplexer sub-circuit MUX controls the reading line RL and the control circuit 40 to be disconnected with each other. The multiplexer sub-circuit MUX controls the control circuit 40 and the data line Data to be connected to each other. The data driving sub-circuit transfers the adjusted data voltage to the sub-pixel sub-unit circuit through the data line Data.

In the fourth example of the pixel unit circuit shown in FIG. 4, the data line Data and the reading line RL are connectable to the control circuit 40 through the multiplexer sub-circuit MUX, so that the data line Data and the reading line RL are connected to the control circuit 40 at different time stages, and the quantity of leading wires may be reduced while normal displaying is achieved.

Figure 5:
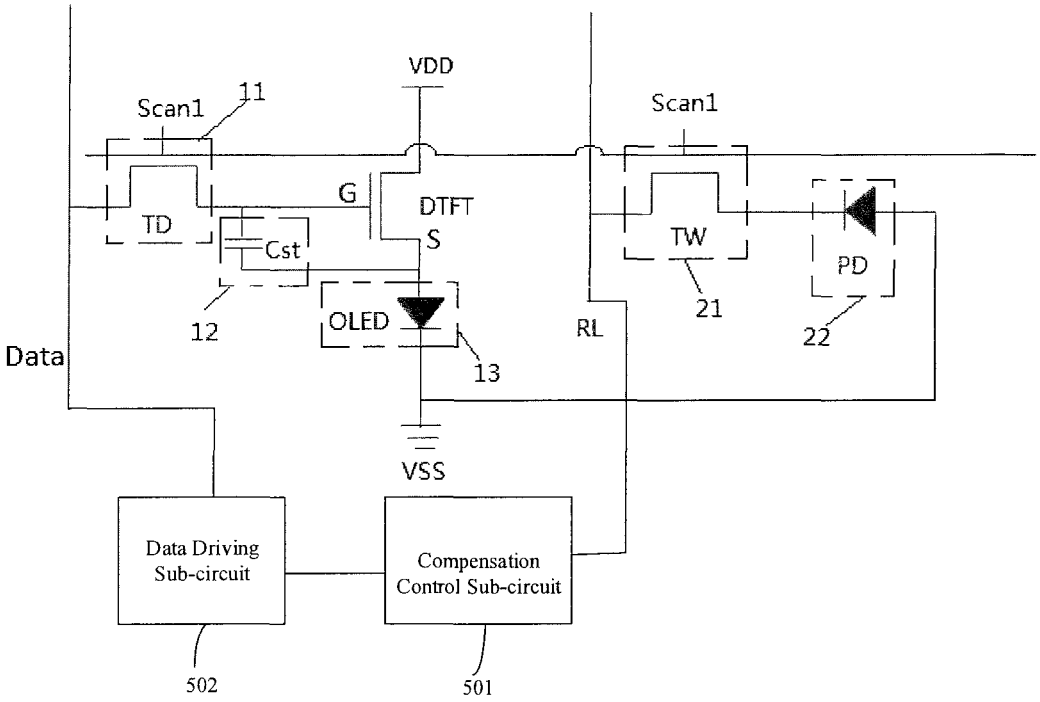
FIG. 5 is a circuit diagram of a fifth example of a pixel unit circuit according to the present disclosure.

As shown in FIG. 5, a fifth example of the pixel unit circuit according to the present disclosure includes a sub-pixel sub-unit circuit and a pixel compensation sub-unit circuit.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert the light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data; the at least two display signal terminals may include a first voltage input terminal and a second voltage input terminal. The at least two compensation signal lines may include a second gate line and a reading line RL. The plurality of compensation signal terminals may include a third voltage input terminal.

The pixel compensation sub-unit circuit may further include a compensation control sub-circuit 501. The compensation control sub-circuit 501 is connected to the reading line RL, and is connected to a data driving sub-circuit 502 connected to the data line Data.

In the fifth example of the pixel unit circuit provided in the present disclosure, the second gate line and the first gate line Scan1 are the same gate line.

In the fifth example of the pixel unit circuit as shown in FIG. 5 of the present disclosure, the first voltage input terminal is the high-voltage input terminal inputted with the high voltage VDD. The second voltage input terminal is the low-voltage input terminal inputted with the low voltage VSS. The third voltage input terminal and the low-voltage input terminal inputted with the low voltage VSS are the same voltage input terminal.

The light emitting element 13 includes an organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the fifth example of the pixel unit circuit as shown in FIG. 5 of the present disclosure, the photosensitive sub-circuit 22 includes the photosensitive diode PD.

The reading control sub-circuit 21 includes the reading control transistor TW. The gate electrode of the reading control transistor TW is connected to the first gate line Scan1, the drain electrode of the reading control transistor TW is connected to the cathode of the photosensitive diode PD, and the source electrode of the reading control transistor TW is connected to the reading line RL.

The anode of the photosensitive diode PD is connected to the third voltage input terminal VI3. In the first example, the third voltage input terminal VI3 may be a low-voltage input terminal inputted with a low voltage.

In the fifth example as shown in FIG. 5 of the present disclosure, both TD and TW may be n-type transistors. However, in actual conditions, the TD and the TW may also be P-type transistors. Types of the transistors are not specifically limited herein.

In the fifth example of the pixel unit circuit as shown in FIG. 5 of the present disclosure, the first gate line and the second gate line are the same gate line. Thus, a quantity of leading wires may be reduced.

In the fifth example shown in FIG. 5, the cathode of the OLED and the anode of the PD are connected to the same voltage input terminal, so that a quantity of signal terminals is reduced and a quantity of leading wires is reduced.

Figure 6:
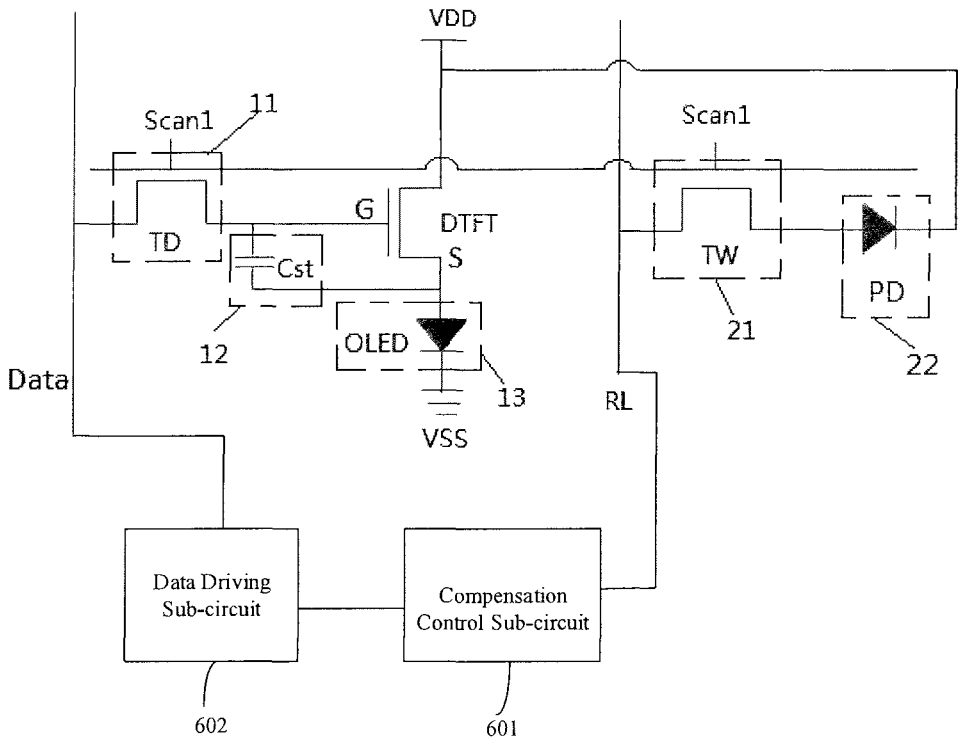
FIG. 6 is a circuit diagram of a sixth example of a pixel unit circuit according to the present disclosure.

As shown in FIG. 6, a sixth example of the pixel unit circuit according to the present disclosure includes the sub-pixel sub-unit circuit and the pixel compensation sub-unit circuit.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include a first gate line Scan1 and a data line Data. The at least two display signal terminals may include the first voltage input terminal and the second voltage input terminal. The at least two compensation signal lines may include a second gate line and the reading line RL. The plurality of compensation signal terminals may include the third voltage input terminal.

The pixel compensation sub-unit circuit may further include a compensation control sub-circuit 601. The compensation control sub-circuit 101 is connected to the reading line RL, and is connected to a data driving sub-circuit 602 connected to the data line Data.

In the sixth example of the pixel unit circuit provided in the present disclosure, the second gate line and the first gate line Scan1 are the same gate line.

In the sixth example of the pixel unit circuit as shown in FIG. 6 of the present disclosure, the first voltage input terminal is the high-voltage input terminal inputted with the high voltage VDD. The second voltage input terminal is the low-voltage input terminal inputted with the low voltage VSS. The light emitting element 13 includes an organic light emitting diode OLED. The third voltage input terminal and the first voltage input terminal are the same voltage input terminal.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode G of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the sixth example of the pixel unit circuit as shown in FIG. 6 of the present disclosure, the photosensitive sub-circuit 22 includes the photosensitive diode PD.

The reading control sub-circuit 21 includes the reading control transistor TW. The gate electrode of the reading control transistor TW is connected to the second gate line Scan2, the drain electrode of the reading control transistor TW is connected to the anode of the photosensitive diode PD, and the source electrode of the reading control transistor is connected to the reading line RL.

The cathode of the photosensitive diode PD is connected to the high-voltage input terminal inputted with the high voltage VDD.

In the sixth example as shown in FIG. 6 of the present disclosure, both TD and TW may be n-type transistors. However, in actual conditions, the TD and the TW may also be P-type transistors. Types of the transistors are not specifically limited herein.

In the sixth example of the pixel unit circuit as shown in FIG. 6 of the present disclosure, the first gate line and the second gate line are the same gate line. Thus, a quantity of leading wires may be reduced.

In the sixth example shown in FIG. 6, the drain electrode of the DTFT and the cathode of the PD are connected to the same voltage input terminal, so that a quantity of signal terminals is reduced and a quantity of leading wires is reduced.

In actual operations, because photo-electric conversion may only be achieved when the photosensitive diode PD is in the reverse bias state, the direction of a PIN junction of the PD in the example shown in FIG. 6 is manufactured to be reverse to that of a PIN junction of the PD shown in FIG. 5.

Figure 7:
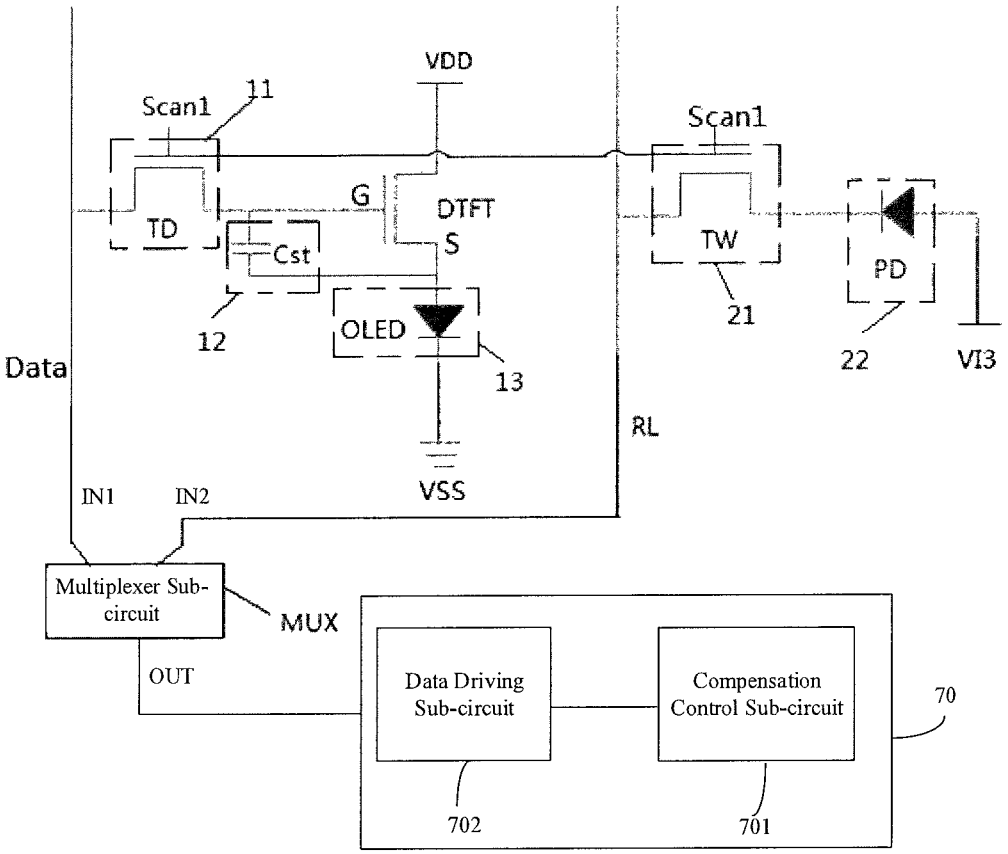
FIG. 7 is a circuit diagram of a seventh example of a pixel unit circuit according to the present disclosure.

As shown in FIG. 7, a seventh example of the pixel unit circuit according to the present disclosure includes the pixel compensation sub-unit circuit, the sub-pixel sub-unit circuit and the multiplexer sub-circuit MUX.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include the first gate line Scan1 and the data line Data. The at least two display signal terminals may include the first voltage input terminal and the second voltage input terminal. The at least two compensation signal lines may include the second gate line Scan2 and the reading line RL. The plurality of compensation signal terminals may include the third voltage input terminal VI3.

The first gate line Scan1 and the second gate line Scan2 may be the same gate line.

In the seventh example of the pixel unit circuit as shown in FIG. 7 of the present disclosure, the first voltage input terminal is the high-voltage input terminal inputted with the high voltage VDD. The second voltage input terminal is the low-voltage input terminal inputted with the low voltage VSS. The light emitting element 13 includes an organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode G of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the seventh example of the pixel unit circuit as shown in FIG. 7 of the present disclosure, the photosensitive sub-circuit 22 includes the photosensitive diode PD.

The reading control sub-circuit 21 includes a reading control transistor TW. The gate electrode of the reading control transistor TW is connected to the first gate line Scan1, the drain electrode of the reading control transistor TW is connected to the cathode of the photosensitive diode PD, and the source electrode of the reading control transistor TW is connected to the reading line RL.

The anode of the photosensitive diode PD is connected to the third voltage input terminal VI3. In the example, the third voltage input terminal VI3 may be a low-voltage input terminal inputted with a low voltage.

The data line Data is connected to the first input terminal IN1 of the multiplexer sub-circuit MUX, the reading line RL is connected to the second input terminal IN2 of the multiplexer sub-circuit MUX, and the output terminal OUT of the multiplexer sub-circuit MUX is connected to the control circuit 70 outside the pixel unit circuit.

In actual operations, in the seventh example shown in FIG. 7, the control circuit 70 is configured with a compensation control sub-circuit 701 and a data driving sub-circuit 702. The compensation control sub-circuit is connectable to the reading line RL through the multiplexer sub-circuit MUX. The data driving sub-circuit 702 is connectable to the data line Data through the multiplexer sub-circuit MUX.

In a reading time stage, the multiplexer sub-circuit MUX controls the reading line RL and the control circuit 70 to be connected to each other. The electrical signal is transferred from the photosensitive diode PD to the compensation control sub-circuit in the control circuit 70 through the reading line RL.

The compensation control sub-circuit detects a value of the electrical signal, compares the value of the electrical signal with a predetermined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage may be obtained.

After the data driving sub-circuit obtains the adjusted data voltage, the multiplexer sub-circuit MUX controls the reading line RL and the control circuit to be disconnected with each other. The multiplexer sub-circuit MUX controls the control circuit and the data line Data to be connected to each other. The data driving sub-circuit transfers the adjusted data voltage to the sub-pixel sub-unit circuit through the data line Data.

In the seventh example of the pixel unit circuit shown in FIG. 7, the data line Data and the reading line RL may be connected to the control circuit through the multiplexer sub-circuit MUX, so that the data line Data and the reading line RL are connected to the control circuit 70 at different time stages, and the quantity of leading wires may be reduced while normal displaying is achieved.

In the seventh example of the pixel unit circuit as shown in FIG. 7 of the present disclosure, the first gate line and the second gate line are the same gate line. Thus, a quantity of leading wires may be reduced.

In the seventh example as shown in FIG. 7 of the present disclosure, both TD and TW may be n-type transistors. However, in actual conditions, the TD and the TW may also be P-type transistors. Types of the transistors are not specifically limited herein.

Figure 8:
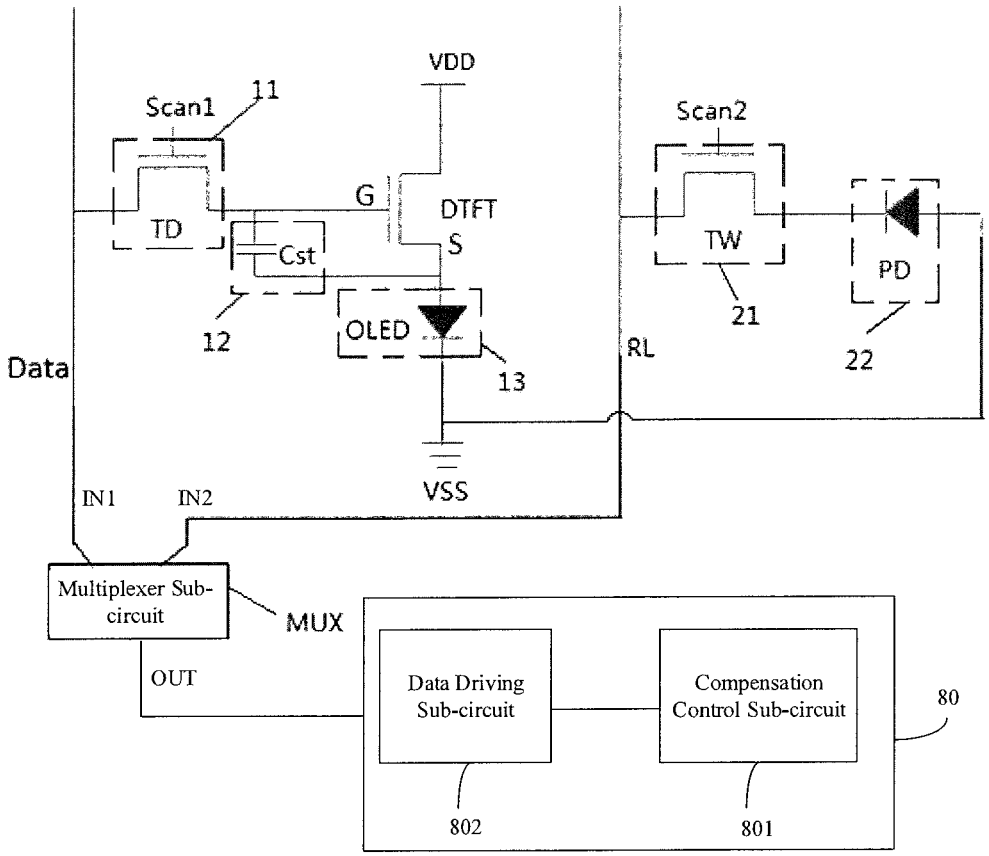
FIG. 8 is a circuit diagram of an eighth example of a pixel unit circuit according to the present disclosure.

As shown in FIG. 8, an eighth example of the pixel unit circuit according to the present disclosure includes the pixel compensation sub-unit circuit, the sub-pixel sub-unit circuit and the multiplexer sub-circuit MUX.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include the first gate line Scan1 and the data line Data; the at least two display signal terminals may include the first voltage input terminal and the second voltage input terminal. The at least two compensation signal lines may include the second gate line Scan2 and the reading line RL. The plurality of compensation signal terminals may include the third voltage input terminal.

In the eighth example of the pixel unit circuit as shown in FIG. 8 of the present disclosure, the first voltage input terminal is the high-voltage input terminal inputted with the high voltage VDD. The second voltage input terminal is the low-voltage input terminal inputted with the low voltage VSS. The light emitting element 13 includes an organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode G of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. the second electrode plate of the storage capacitor Cst is connected to the source electrode S of the driving transistor DTFT.

In the eighth example of the pixel unit circuit as shown in FIG. 8 of the present disclosure, the photosensitive sub-circuit 22 includes the photosensitive diode PD.

The reading control sub-circuit 21 includes the reading control transistor TW. The gate electrode of the reading control transistor TW is connected to the second gate line Scan2, the drain electrode of the reading control transistor TW is connected to the cathode of the photosensitive diode PD, and the source electrode of the reading control transistor TW is connected to the reading line RL.

The anode of the photosensitive diode PD is connected to the low-voltage input terminal inputted with the low voltage VSS.

The data line Data is connected to the first input terminal IN1 of the multiplexer sub-circuit MUX, the reading line RL is connected to the second input terminal IN2 of the multiplexer sub-circuit MUX, and the output terminal OUT of the multiplexer sub-circuit MUX is connected to the control circuit 80 outside the pixel unit circuit.

In actual operations, in the eighth example shown in FIG. 8, the control circuit 80 is configured with the compensation control sub-circuit 801 and a data driving sub-circuit 802. The compensation control sub-circuit is connectable to the reading line RL through the multiplexer sub-circuit MUX. The data driving sub-circuit 802 is connectable to the data line Data through the multiplexer sub-circuit MUX.

In a reading time stage, the multiplexer sub-circuit MUX controls the reading line RL and the control circuit to be connected to each other. The electrical signal is transferred from the photosensitive diode PD to the compensation control sub-circuit in the control circuit 80 through the reading line RL.

The compensation control sub-circuit detects a value of the electrical signal, compares the value of the electrical signal with a pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage may be obtained.

After the data driving sub-circuit obtains the adjusted data voltage, the multiplexer sub-circuit MUX controls the reading line RL and the control circuit 80 to be disconnected with each other. The multiplexer sub-circuit MUX controls the control circuit 80 and the data line Data to be connected to each other. The data driving sub-circuit transfers the adjusted data voltage to the sub-pixel sub-unit circuit through the data line Data.

In the eighth example of the pixel unit circuit shown in FIG. 8, the data line Data and the reading line RL is connectable to the control circuit through the multiplexer sub-circuit MUX, so that the data line Data and the reading line RL may be connected to the control circuit 80 at different times, and the quantity of leading wires may be reduced while normal displaying is achieved.

In the eighth example shown in FIG. 8, the second voltage input terminal and the third voltage input terminal are the same voltage input terminal, the cathode of the OLED and the anode of the PD are connected to the same voltage input terminal, so that the quantity of signal terminals is reduced and the quantity of leading wires is reduced.

In the eight example as shown in FIG. 8 of the present disclosure, both TD and TW may be n-type transistors. However, in actual conditions, the TD and the TW may also be P-type transistors. Types of the transistors are not specifically limited herein.

Figure 9:
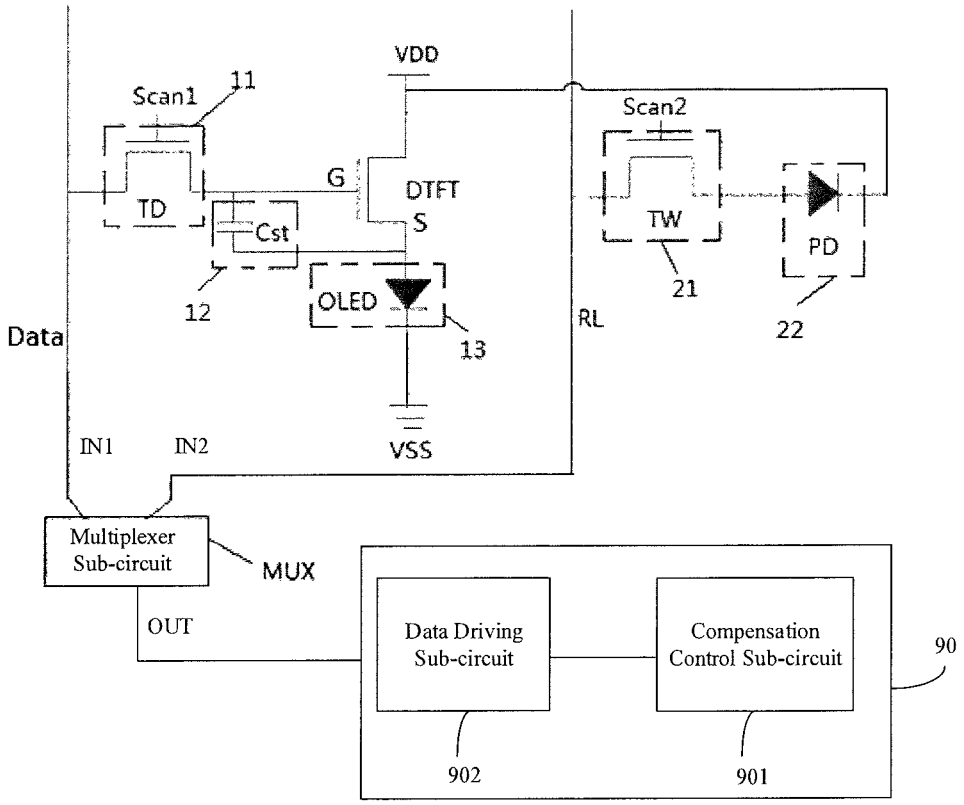
FIG. 9 is a circuit diagram of a ninth example of a pixel unit circuit according to the present disclosure.

As shown in FIG. 9, a ninth example of the pixel unit circuit according to the present disclosure includes the pixel compensation sub-unit circuit, the sub-pixel sub-unit circuit and the multiplexer sub-circuit MUX.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include the first gate line Scan1 and the data line Data. The at least two display signal terminals may include the first voltage input terminal and the second voltage input terminal. The at least two compensation signal lines may include the second gate line Scan2 and the reading line RL. The plurality of compensation signal terminals may include the third voltage input terminal.

In the ninth example of the pixel unit circuit as shown in FIG. 9 of the present disclosure, the first voltage input terminal is the high-voltage input terminal inputted with the high voltage VDD. The second voltage input terminal is the low-voltage input terminal inputted with the low voltage VSS. The light emitting element 13 includes the organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the ninth example of the pixel unit circuit as shown in FIG. 9 of the present disclosure, the photosensitive sub-circuit 22 includes the photosensitive diode PD.

The reading control sub-circuit 21 includes the reading control transistor TW. The gate electrode of the reading control transistor TW is connected to the second gate line Scan2, the drain electrode of the reading control transistor TW is connected to the anode of the photosensitive diode PD, and the source electrode of the reading control transistor TW is connected to the reading line RL.

The cathode of the photosensitive diode PD is connected to the high-voltage input terminal inputted with the high voltage VDD.

The data line Data is connected to the first input terminal IN1 of the multiplexer sub-circuit MUX, the reading line RL is connected to the second input terminal IN2 of the multiplexer sub-circuit MUX, and the output terminal OUT of the multiplexer sub-circuit MUX is connected to the control circuit 90 outside the pixel unit circuit.

In actual operations, in the ninth example shown in FIG. 9, the control circuit 90 is configured with the compensation control sub-circuit 901 and a data driving sub-circuit 902. The compensation control sub-circuit 901 is connectable to the reading line RL through the multiplexer sub-circuit MUX. The data driving sub-circuit 902 is connectable to the data line Data through the multiplexer sub-circuit MUX.

In a reading time stage, the multiplexer sub-circuit MUX controls the reading line RL and the control circuit 90 to be connected to each other. The electrical signal is transferred from the photosensitive diode PD to the compensation control sub-circuit in the control circuit 90 through the reading line RL.

The compensation control sub-circuit detects a value of the electrical signal, compares the value of the electrical signal with the pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage may be obtained.

After the data driving sub-circuit obtains the adjusted data voltage, the multiplexer sub-circuit MUX controls the reading line RL and the control circuit 90 to be disconnected with each other. The multiplexer sub-circuit MUX controls the control circuit 90 and the data line Data to be connected to each other. The data driving sub-circuit transfers the adjusted data voltage to the sub-pixel sub-unit circuit through the data line Data.

In the ninth example of the pixel unit circuit shown in FIG. 9, the data line Data and the reading line RL are connectable to the control circuit through the multiplexer sub-circuit MUX, so that the data line Data and the reading line RL are connected to the control circuit 90 at different times, and the quantity of leading wires may be reduced while normal displaying is achieved.

In the ninth example shown in FIG. 9, the first voltage input terminal and the third voltage input terminal are the same voltage input terminal, the drain electrode of the DTFT and the cathode of the PD are connected to the same voltage input terminal, so that the quantity of signal terminals is reduced and the quantity of leading wires is reduced.

In the ninth example as shown in FIG. 9 of the present disclosure, both TD and TW may be n-type transistors. However, in actual conditions, the TD and the TW may also be P-type transistors. Types of the transistors are not specifically limited herein.

Figure 10:
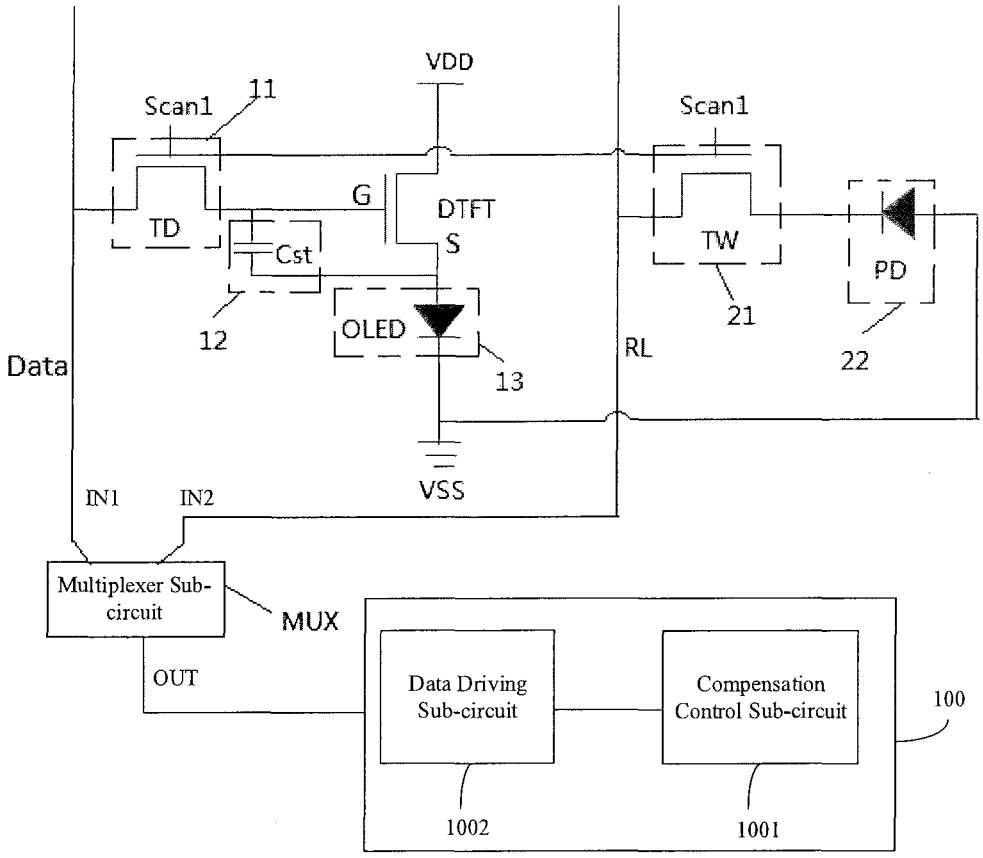
FIG. 10 is a circuit diagram of a tenth example of a pixel unit circuit according to the present disclosure.

As shown in FIG. 10, a tenth example of the pixel unit circuit according to the present disclosure includes the pixel compensation sub-unit circuit, the sub-pixel sub-unit circuit and the multiplexer sub-circuit MUX.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include the first gate line Scan1 and the data line Data. The at least two display signal terminals may include the first voltage input terminal and the second voltage input terminal. The at least two compensation signal lines may include the second gate line and the reading line RL. The plurality of compensation signal terminals may include the third voltage input terminal.

The first gate line Scan1 and the second gate line Scan2 may be the same gate line.

In the tenth example of the pixel unit circuit as shown in FIG. 10 of the present disclosure, the first voltage input terminal is the high-voltage input terminal inputted with the high voltage VDD. The second voltage input terminal is the low-voltage input terminal inputted with the low voltage VSS. The light emitting element 13 includes the organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode G of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the tenth example of the pixel unit circuit as shown in FIG. 10 of the present disclosure, the photosensitive sub-circuit 22 includes the photosensitive diode PD.

The reading control sub-circuit 21 includes the reading control transistor TW. The gate electrode of the reading control transistor TW is connected to the first gate line Scan1, the drain electrode of the reading control transistor TW is connected to the cathode of the photosensitive diode PD, and the source electrode of the reading control transistor is connected to the reading line RL.

The anode of the photosensitive diode PD is connected to the low-voltage input terminal inputted with the low voltage VSS.

The data line Data is connected to the first input terminal IN1 of the multiplexer sub-circuit MUX, the reading line RL is connected to the second input terminal IN2 of the multiplexer sub-circuit MUX, and the output terminal OUT of the multiplexer sub-circuit MUX is connected to the control circuit 100 outside the pixel unit circuit.

In actual operations, in the tenth example shown in FIG. 10, the control circuit 100 is configured with the compensation control sub-circuit 1001 and a data driving sub-circuit 1002. The compensation control sub-circuit is connectable to the reading line RL through the multiplexer sub-circuit MUX. The data driving sub-circuit 702 is connectable to the data line Data through the multiplexer sub-circuit MUX.

In a reading time stage, the multiplexer sub-circuit MUX controls the reading line RL and the control circuit 100 to be connected to each other. The electrical signal is transferred from the photosensitive diode PD to the compensation control sub-circuit in the control circuit 100 through the reading line RL.

The compensation control sub-circuit detects a value of the electrical signal, compares the value of the electrical signal with the pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage may be obtained.

After the data driving sub-circuit obtains the adjusted data voltage, the multiplexer sub-circuit MUX controls the reading line RL and the control circuit 100 to be disconnected with each other. The multiplexer sub-circuit MUX controls the control circuit 100 and the data line Data to be connected to each other. The data driving sub-circuit transfers the adjusted data voltage to the sub-pixel sub-unit circuit through the data line Data.

In the tenth example of the pixel unit circuit shown in FIG. 10, the data line Data and the reading line RL are connectable to the control circuit through the multiplexer sub-circuit MUX, so that the data line Data and the reading line RL are connected to the control circuit 100 at different time stages, and the quantity of leading wires may be reduced while normal displaying is achieved.

In the tenth example shown in FIG. 10, the second voltage input terminal and the third voltage input terminal are the same voltage input terminal, the cathode of the OLED and the anode of the PD are connected to the same voltage input terminal, so that the quantity of signal terminals is reduced and the quantity of leading wires is reduced.

In the tenth example of the pixel unit circuit as shown in FIG. 10 of the present disclosure, the first gate line and the second gate line are the same gate line. Thus, a quantity of leading wires may be reduced.

In the tenth example as shown in FIG. 10 of the present disclosure, both TD and TW may be n-type transistors. However, in actual conditions, the TD and the TW may also be P-type transistors. Types of the transistors are not specifically limited herein.

Figure 11:
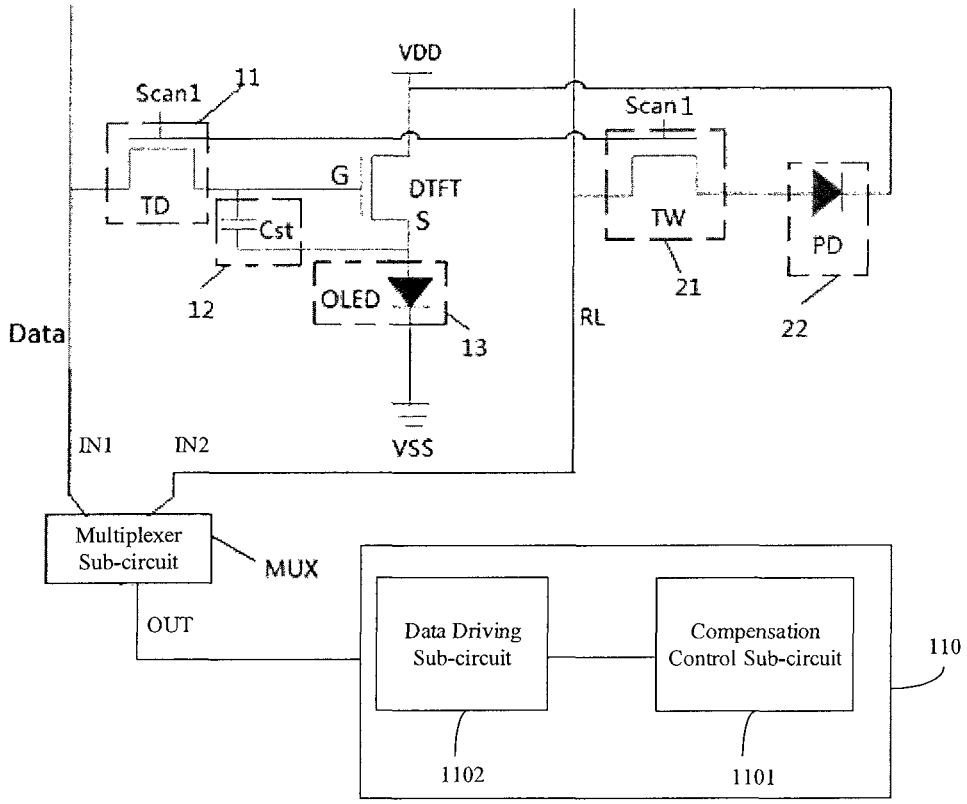
FIG. 11 is a circuit diagram of an eleventh example of a pixel unit circuit according to the present disclosure.

As shown in FIG. 11, an eleventh example of the pixel unit circuit according to the present disclosure includes the pixel compensation sub-unit circuit, the sub-pixel sub-unit circuit and the multiplexer sub-circuit MUX.

The sub-pixel sub-unit circuit includes the data writing sub-circuit 11, the storage capacitor sub-circuit 12, the driving transistor DTFT and the light emitting element 13. The sub-pixel sub-unit circuit is connected to at least two display signal lines and at least two display signal terminals.

The pixel compensation sub-unit circuit includes the reading control sub-circuit 21 and the photosensitive sub-circuit 22 configured to convert light emitted from the light emitting element 13 to an electrical signal. The pixel compensation sub-unit circuit is connected to at least two compensation signal lines and a compensation signal terminal.

The at least two display signal lines may include the first gate line Scan1 and the data line Data. The at least two display signal terminals may include the first voltage input terminal and the second voltage input terminal. The at least two compensation signal lines may include the second gate line and the reading line RL. The plurality of compensation signal terminals may include the third voltage input terminal.

The first gate line Scan1 and the second gate line Scan2 may be the same gate line.

In the eleventh example of the pixel unit circuit as shown in FIG. 11 of the present disclosure, the first voltage input terminal is the high-voltage input terminal inputted with the high voltage VDD. The second voltage input terminal is the low-voltage input terminal inputted with the low voltage VSS. The light emitting element 13 includes the organic light emitting diode OLED.

The data writing sub-circuit 11 includes the data writing transistor TD. The gate electrode of the data writing transistor TD is connected to the first gate line Scan1, the drain electrode of the data writing transistor TD is connected to the data line Data, and the source electrode of the data writing transistor TD is connected to the gate electrode G of the driving transistor DTFT.

The drain electrode of the driving transistor DTFT is connected to the high-voltage input terminal inputted with the high voltage VDD. The source electrode S of the driving transistor DTFT is connected to the anode of the organic light emitting diode OLED.

The cathode of the organic light emitting diode OLED is connected to the low-voltage input terminal inputted with the low voltage VSS.

The storage capacitor sub-circuit 12 includes the storage capacitor Cst. The first electrode plate of the storage capacitor Cst is connected to the gate electrode G of the driving transistor DTFT. The second electrode plate of the storage capacitor Cst is connected to the source electrode S of the driving transistor DTFT.

In the eleventh example of the pixel unit circuit as shown in FIG. 11 of the present disclosure, the photosensitive sub-circuit 22 includes the photosensitive diode PD.

The reading control sub-circuit 21 includes the reading control transistor TW. The gate electrode of the reading control transistor TW is connected to the first gate line Scan1, the drain electrode of the reading control transistor TW is connected to the anode of the photosensitive diode PD, and the source electrode of the reading control transistor TW is connected to the reading line RL.

The cathode of the photosensitive diode PD is connected to the high-voltage input terminal inputted with the high voltage VDD.

The data line Data is connected to the first input terminal IN1 of the multiplexer sub-circuit MUX, the reading line RL is connected to the second input terminal IN2 of the multiplexer sub-circuit MUX, and the output terminal OUT of the multiplexer sub-circuit MUX is connected to the control circuit 110 outside the pixel unit circuit.

In actual operations, in the eleventh example shown in FIG. 11, the control circuit 110 is configured with the compensation control sub-circuit 1101 and a data driving sub-circuit 1102. The compensation control sub-circuit is connectable to the reading line RL through the multiplexer sub-circuit MUX. The data driving sub-circuit 702 is connectable to the data line Data through the multiplexer sub-circuit MUX.

In a reading time stage, the multiplexer sub-circuit MUX controls the reading line RL and the control circuit 110 to be connected to each other. The electrical signal is transferred from the photosensitive diode PD to the compensation control sub-circuit in the control circuit 110 through the reading line RL.

The compensation control sub-circuit detects a value of the electrical signal, compares the value of the electrical signal with the pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage may be obtained.

After the data driving sub-circuit obtains the adjusted data voltage, the multiplexer sub-circuit MUX controls the reading line RL and the control circuit 110 to be disconnected with each other. The multiplexer sub-circuit MUX controls the control circuit 110 and the data line Data to be connected to each other. The data driving sub-circuit transfers the adjusted data voltage to the sub-pixel sub-unit circuit through the data line Data.

In the eleventh example of the pixel unit circuit shown in FIG. 11, the data line Data and the reading line RL are connectable to the control circuit through the multiplexer sub-circuit MUX, so that the data line Data and the reading line RL are connected to the control circuit 110 at different time stage, and the quantity of leading wires may be reduced while normal displaying is achieved.

In the eleventh example shown in FIG. 11, the first voltage input terminal and the third voltage input terminal are the same voltage input terminal, the drain electrode of the DTFT and the cathode of the PD are connected to the same voltage input terminal, so that the quantity of signal terminals is reduced and the quantity of leading wires is reduced.

In the eleventh example of the pixel unit circuit as shown in FIG. 11 of the present disclosure, the first gate line and the second gate line are the same gate line. Thus, a quantity of leading wires may be reduced.

In the eleventh example as shown in FIG. 11 of present disclosure, both TD and TW may be n-type transistors. However, in actual conditions, the TD and the TW may also be P-type transistors. Types of the transistors are not specifically limited herein.

In the pixel unit circuit provided in the embodiments of the present disclosure, the quantity of sub-pixel sub-unit circuits included in the pixel unit circuit is at least two.

The pixel unit circuit further includes a display control sub-circuit. The display control sub-circuit controls the at least two sub-pixel sub-unit circuits included in the pixel unit circuit to emit light at different time stages.

When one pixel compensation sub-unit circuit corresponds to at least two sub-pixel sub-unit circuits, the at least two sub-pixel sub-unit circuits emit light at different time stages. In the embodiments of the pixel unit circuit in the present disclosure, one pixel compensation sub-unit circuit corresponds to the at least two sub-pixel sub-unit circuits to reduce a quantity of the pixel compensation sub-unit circuits and reduce quantities of devices, leading wires and signal terminals.

Figure 12:
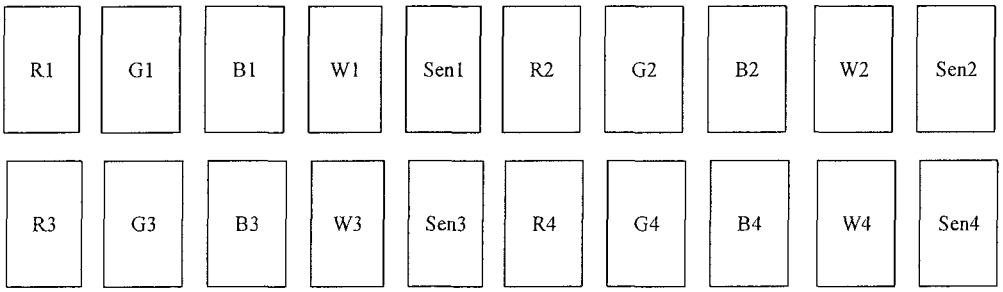
FIG. 12 is a structural schematic diagram of a pixel circuit according to the present disclosure.

As shown in FIG. 12, a first red sub-pixel sub-unit circuit is labeled as R1, a first green sub-pixel sub-unit is labeled as G1, a first blue sub-pixel sub-unit is labeled as B1, a first white sub-pixel sub-unit is labeled as W1, and a first pixel compensation sub-unit circuit is labeled as Sen1.

A second red sub-pixel sub-unit circuit is labeled as R2, a second green sub-pixel sub-unit is labeled as G2, a second blue sub-pixel sub-unit is labeled as B2, a second white sub-pixel sub-unit is labeled as W2, and a second pixel compensation sub-unit circuit is labeled as Sen2.

A third red sub-pixel sub-unit circuit is labeled as R3, a third green sub-pixel sub-unit is labeled as G3, a third blue sub-pixel sub-unit is labeled as B3, a third white sub-pixel sub-unit is labeled as W3, and a third pixel compensation sub-unit circuit is labeled as Sen3.

A fourth red sub-pixel sub-unit circuit is labeled as R4, a fourth green sub-pixel sub-unit is labeled as G4, a fourth blue sub-pixel sub-unit is labeled as B4, a fourth white sub-pixel sub-unit is labeled as W4, and a fourth pixel compensation sub-unit circuit is labeled as Sen4.

In the example shown in FIG. 12, one pixel compensation sub-pixel circuit corresponds to four sub-pixel sub-unit circuits. However, in actual applications, one pixel compensation sub-unit circuit may also correspond to N (or more than N) sub-pixel sub-unit circuits, wherein N may be an integer larger than 1.

In the example shown in FIG. 12, one pixel compensation sub-unit circuit corresponds to one pixel unit, and the pixel unit includes four sub-pixel sub-unit circuits. In actual applications, one pixel compensation sub-unit circuit may also correspond to at least two pixel units.

In the pixel unit circuit, the method for driving the pixel unit circuit and the pixel circuit of the present disclosure, signal lines are re-used, signal terminals are re-used, or the display signal line and the compensation signal line are selected by the multiplexer sub-circuit so that the display signal line and the compensation signal line are connected to the control circuit outside the pixel unit circuit at different time stages. Thus, a quantity of leading wires and a quantity of signal terminals may be reduced while implementing normal displaying, and a design of the pixel unit circuit is optimized, thereby facilitating manufacturing a product of a high PPI.

Referring to FIG. 12, some embodiments of the present disclosure further provide a pixel circuit. The pixel circuit includes a plurality of pixel unit circuits provided in the above embodiments of the present disclosure. The plurality of pixel unit circuits is arranged in a matrix including multiple rows and multiple columns.

Optionally, pixel compensation sub-unit circuits included in a same row of pixel unit circuits of the plurality of pixel unit circuits are connected to a same second gate line. Pixel compensation sub-unit circuits included in a same column of pixel unit circuits of the plurality of pixel unit circuits are connected to a same reading line.

Optionally, the pixel circuit further includes the above control circuit. The control circuit includes the compensation control sub-circuit and the data driving sub-circuit connected to the compensation control sub-circuit. The compensation control sub-circuit is connectable to the reading line through the multiplexer sub-circuit, and the data driving sub-circuit is connectable to the data line through the multiplexer sub-circuit. The compensation control sub-circuit is configured to read the electrical signal in the reading line, compares the value of the electrical signal with the pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may obtain the data voltage adjustment signal. The data driving sub-circuit is configured to adjust the data voltage outputted to the data line according to the data voltage adjustment signal so that the adjusted data voltage is obtained, and transmit the adjusted data voltage to the at least one sub-pixel sub-unit circuit.

Figure 13:
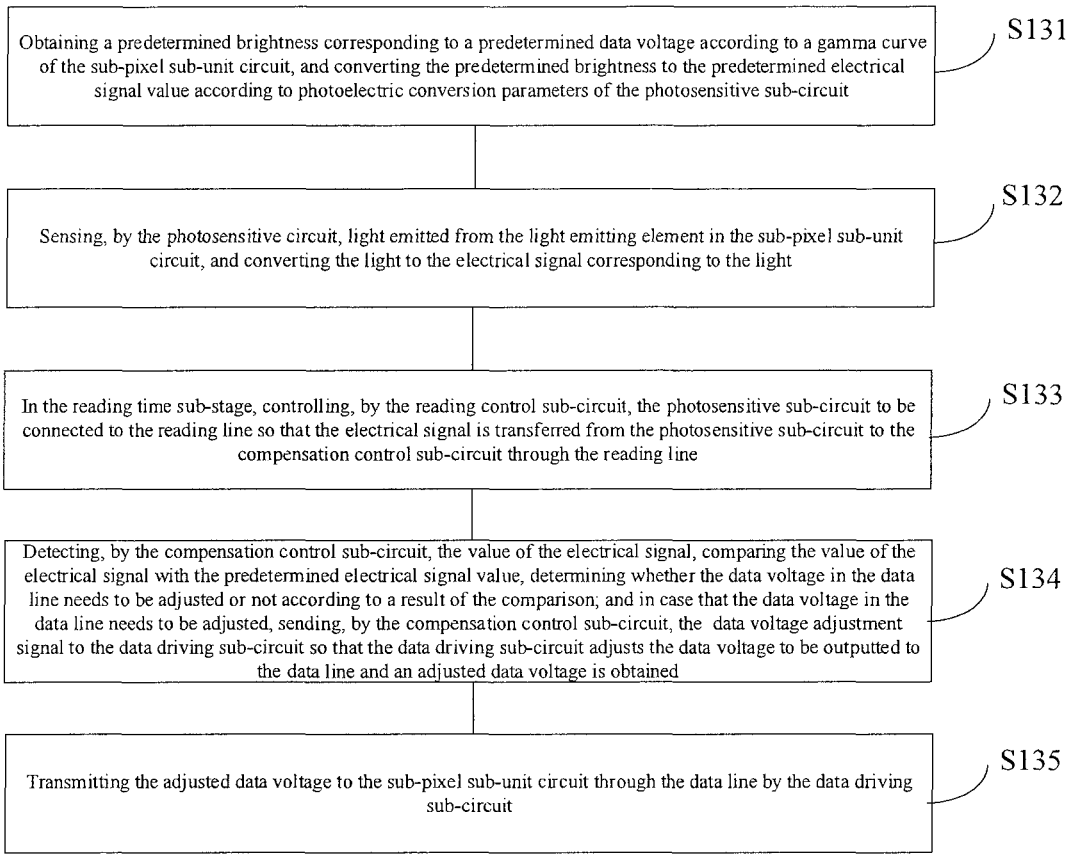
FIG. 13 is a flowchart of a method for driving a pixel unit circuit according to the present disclosure.
Figure 14:
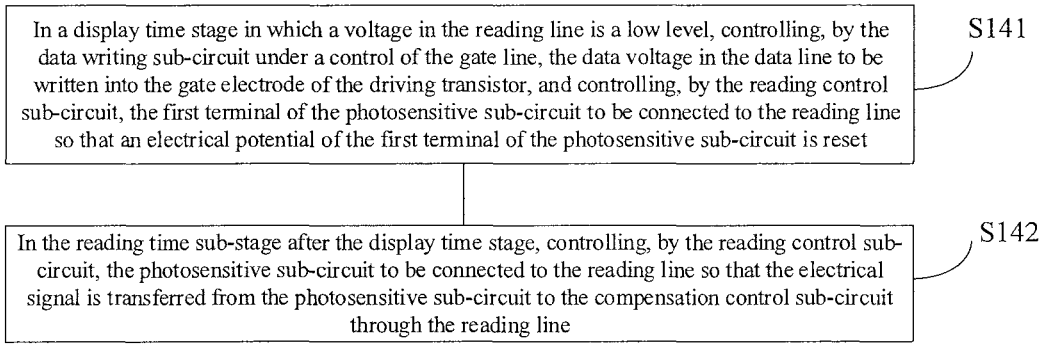
FIG. 14 is another flowchart of the method for driving the pixel unit circuit according to the present disclosure.

Some embodiments of the present disclosure further provide a method for driving a pixel unit circuit, which is applied to the above pixel unit circuit of the present disclosure. The sub-pixel sub-unit circuit included in the pixel unit circuit includes the light-emitting element. The pixel compensation sub-unit circuit includes the reading control sub-circuit, the photosensitive sub-circuit configured to convert light emitted from the light emitting element to an electrical signal, and the compensation control sub-circuit connected to the reading line. The pixel compensation sub-unit circuit is connected to the data driving sub-circuit. The data driving sub-circuit is configured to provide the data voltage to the data line connected to the sub-pixel sub-unit circuit. A compensation time stage is arranged between two display time stages. The compensation time stage includes a reading time sub-stage corresponding to the pixel compensation sub-unit circuit. The method for driving the pixel unit circuit includes steps S131-S135, as shown in FIG. 13.

S131: obtaining a predetermined brightness corresponding to a predetermined data voltage according to a gamma curve of the sub-pixel sub-unit circuit, and converting the predetermined brightness to the predetermined electrical signal value according to photoelectric conversion parameters of the photosensitive sub-circuit.

S132: sensing, by the photosensitive circuit, light emitted from the light emitting element in the sub-pixel sub-unit circuit, and converting the light to the electrical signal corresponding to the light.

S133: in the reading time sub-stage, controlling, by the reading control sub-circuit, the photosensitive sub-circuit to be connected to the reading line so that the electrical signal is transferred from the photosensitive sub-circuit to the compensation control sub-circuit through the reading line.

S134: detecting, by the compensation control sub-circuit, the value of the electrical signal, comparing the value of the electrical signal with the predetermined electrical signal value, determining whether the data voltage in the data line needs to be adjusted or not according to a result of the comparison; and in case that the data voltage in the data line needs to be adjusted, sending, by the compensation control sub-circuit, the data voltage adjustment signal to the data driving sub-circuit so that the data driving sub-circuit adjusts the data voltage to be outputted to the data line and an adjusted data voltage is obtained.

S135: transmitting the adjusted data voltage to the sub-pixel sub-unit circuit through the data line by the data driving sub-circuit.

When the pixel unit circuit provided in some embodiments of the present disclosure operates, the predetermined brightness corresponding to the predetermined data voltage is obtained firstly according to the Gamma curve of the sub-pixel sub-unit circuit needing to be monitored, and then the predetermined brightness is converted to the predetermined electrical signal value according to the photoelectric conversion parameters of the photosensitive sub-circuit (in actual applications, the electrical signal may include at least one of an electrical current signal, an electrical voltage signal, an electric charge signal). Then, in spare time between display multiple frames of images (i.e., in the reading time sub-stage), brightness of each sub-pixel is monitored row by row. The compensation control sub-circuit acquires the value of the electrical signal in the photosensitive sub-circuit, and compares the value with the predetermined value of the electrical signal. If the brightness satisfies a requirement, the compensation control sub-circuit determines that the voltage of the sub-pixel does not need to be adjusted. If the brightness deviates from the requirement, such as the brightness is larger, the photosensitive sub-circuit may obtain a value of the electrical signal larger than the predetermined electrical signal value, and the value larger than the predetermined electrical signal value is transmitted to the compensation control sub-circuit so that the data voltage for the sub-pixel is reduced. Thereafter, the photosensitive sub-pixel obtains the value of the electrical signal again, and the compensation control sub-circuit compares the value of the electrical signal with the predetermined electrical signal value, and the obtaining and comparison operations are repeated as such, and adjustment is repeated until the image is displayed normally.

In actual applications, the electrical signal may include at least one of the electrical voltage signal, the electrical current signal or the electric charge signal. The value of the electrical signal may include at least one of an electrical voltage value, an electrical current value or an electric charge amount.

Specifically, the sub-pixel sub-unit circuit further includes the data writing sub-circuit and the driving transistor. The at least two display signal lines include the first gate line and the data line. The at least two compensation signal lines include the second gate line and the reading line. The data writing sub-circuit is connected to the first gate line, the data line and the gate electrode of the driving transistor. The reading control sub-circuit is connected to the second gate line, the reading line and the first terminal of the photosensitive sub-circuit. The first gate line and the second gate line are the same gate line. The method for driving the pixel unit circuit further includes steps S141-S142.

S141: in a display time stage in which a voltage in the reading line is a low level, controlling, by the data writing sub-circuit under a control of the gate line, the data voltage in the data line to be written into the gate electrode of the driving transistor, and controlling, by the reading control sub-circuit, the first terminal of the photosensitive sub-circuit to be connected to the reading line so that an electrical potential of the first terminal of the photosensitive sub-circuit is reset.

S142: in the reading time sub-stage after the display time stage, controlling, by the reading control sub-circuit, the photosensitive sub-circuit to be connected to the reading line so that the electrical signal is transferred from the photosensitive sub-circuit to the compensation control sub-circuit through the reading line.

Specifically, the step S142 further includes: in the reading time sub-stage, controlling, by the reading control sub-circuit, the first terminal of the photosensitive sub-circuit to be connected to the reading line so that the electrical signal is transferred from the photosensitive sub-circuit to the compensation control sub-circuit through the reading line.

In actual operations, the first gate line and the second gate line are the same gate line. In the display time stage, the data voltage is written, the electrical potential of the first terminal of the photosensitive sub-circuit is reset. In the reading time sub-stage after the display time stage, the reading control sub-circuit controls the photosensitive sub-circuit to be connected to the reading line so that the electrical signal is transferred from the photosensitive sub-circuit to the compensation control sub-circuit through the reading line.

Specifically, the sub-pixel sub-unit circuit further includes the data writing sub-circuit and the driving transistor. The at least two display signal lines include the first gate line and the data line. The at least two compensation signal lines include the second gate line and the reading line. The data writing sub-circuit is connected word the first gate line, the data line and the gate electrode of the driving transistor. The reading control sub-circuit is connected to the second gate line, the reading line and the first terminal of the photosensitive sub-circuit. The pixel unit circuit includes the multiplexer sub-circuit. The data line is connected to the first input terminal of the multiplexer sub-circuit, the reading line is connected to the second input terminal of the second multiplexer sub-circuit. The output terminal of the multiplexer sub-circuit is connected to the control circuit. The compensation control sub-circuit and the data driving sub-circuit are arranged in the control circuit. The compensation control sub-circuit is connectable to the reading line through the multiplexer sub-circuit.

In the reading time sub-stage, the reading control sub-circuit controls the photosensitive sub-circuit to be connected to the reading line. The electrical signal being transferred from the photosensitive sub-circuit to the compensation control sub-circuit though the reading line includes: in the reading time sub-stage, controlling, by the multiplexer sub-circuit, the reading line to be connected to the control circuit sot that the electrical signal is transferred from the photosensitive sub-circuit to the compensation control sub-circuit in the control circuit through the reading line.

After the data driving sub-circuit obtains the adjusted data voltage, the method for driving the pixel unit circuit further includes: controlling, by the multiplexer sub-circuit, the reading line to be disconnected from the control circuit; controlling, by the multiplexer sub-circuit, the control circuit to be connected to the data line; and transmitting, by the data driving sub-circuit, the adjusted data voltage to the sub-pixel sub-unit circuit through the data line.

In actual applications, when the pixel unit circuit includes the multiplexer sub-circuit connected to the data line and the reading line, the multiplexer sub-circuit controls the reading line to be connected to the control circuit in the reading time sub-stage, and the electrical signal is transferred from the photosensitive sub-circuit to the compensation control sub-circuit in the control circuit through the reading line. The compensation control sub-circuit detects a value of the electrical signal, compares the value of the electrical signal with the pre-determined electrical signal value, determines whether the data voltage in the data line needs to be adjusted or not according to a result of the comparison. In case that the data voltage in the data line needs to be adjusted, the compensation control sub-circuit sends the data voltage adjustment signal to the data driving sub-circuit so that the data driving sub-circuit may adjust the data voltage to be outputted to the data line and an adjusted data voltage is obtained. After the data driving sub-circuit obtains the adjusted data voltage, the multiplexer sub-circuit controls the reading line and the control circuit to be disconnected with each other. The multiplexer sub-circuit controls the control circuit and the data line to be connected to each other. The data driving sub-circuit transfers the adjusted data voltage to the sub-pixel sub-unit circuit through the data line.

The pixel circuit provided in some embodiments of the present disclosure includes a plurality of pixel unit circuits arranged in multiple rows and multiple columns.

Optionally, the at least two compensation signal lines may include the second gate line and the reading line. Pixel compensation sub-unit circuits included in a same row of pixel unit circuits of the plurality of pixel unit circuits are connected to a same second gate line. Pixel compensation sub-unit circuits included in a same column of pixel unit circuits of the plurality of pixel unit circuits are connected to a same reading line.

The above described embodiments of the present disclosure are optional embodiments. It should be noted that numerous modification and embellishment may be made by one of ordinary skills in the art without departing from the spirit of the present disclosure, and such modification and embellishment also fall within the scope of the present disclosure.

What is claimed is:

1. A pixel unit circuit, comprising:

at least one sub-pixel sub-unit circuit and a pixel compensation sub-unit circuit, wherein the at least one sub-pixel sub-unit circuit is connected to at least two display signal lines and at least two display signal terminals, the pixel compensation sub-unit circuit is connected to at least two compensation signal lines and at least one compensation signal terminal, the at least two display signal lines comprise a first gate line and a data line; the at least two compensation signal lines comprise a second gate line and a reading line; and the pixel unit circuit further comprises a multiplexer sub-circuit, the data line is connected to a first input terminal of the multiplexer sub-circuit, the reading line is connected to a second input terminal of the multiplexer sub-circuit and an output terminal of the multiplexer sub-circuit is connected to a control circuit outside the pixel unit circuit.

2. The pixel unit circuit according to claim 1, wherein each of the at least one sub-pixel sub-unit circuit comprises a data writing sub-circuit, a driving transistor, and a light emitting element; the pixel compensation sub-unit circuit comprises a reading control sub-circuit and a photosensitive sub-circuit configured to convert light emitted from the light emitting element to an electric signal;

the at least two display signal terminals comprise a first voltage input terminal and a second voltage input terminal; the at least one compensation signal terminal comprises a third voltage input terminal;

the data writing sub-circuit is connected to the first gate line, the data line and a gate electrode of the driving transistor a first electrode of the driving transistor is connected to the first voltage input terminal, a second electrode of the driving transistor is connected to a first electrode of the light emitting element, and a second electrode of the light emitting element is connected to the second voltage input terminal;

the reading control sub-circuit is connected to the second gate line, the reading line and a first terminal of the photosensitive sub-circuit; a second terminal of the photosensitive sub-circuit is connected to the third voltage input terminal.

3. The pixel unit circuit according to claim 2, wherein the pixel compensation sub-unit circuit further comprises a compensation control sub-circuit, the compensation control sub-circuit is connected to the reading line and is connected to a data driving sub-circuit connected to the data line;

the compensation control sub-circuit is configured to read an electrical signal in the reading line, compare a value of the electrical signal with a pre-determined electrical signal value, determine whether a voltage in the data line needs to be adjusted or not according to a result of the comparison; and in case that the voltage in the data line needs to be adjusted, the compensation control sub-circuit is configured to send a data voltage adjustment signal to the data driving sub-circuit so that the data driving sub-circuit obtains the data voltage adjustment signal;

the data driving sub-circuit is configured to adjust a data voltage to be outputted to the data line according the data voltage adjustment signal and obtain an adjusted data voltage, and send the adjusted data voltage to the at least one sub-pixel sub-circuit through the data line.

4. The pixel unit circuit according to claim 2, wherein the second voltage input terminal and the third voltage input terminal are a same voltage input terminal;

both the second voltage input terminal and the third voltage input terminal are low voltage input terminals;

the photosensitive sub-circuit comprises a photosensitive diode, an anode of the photosensitive diode is connected to the third voltage input terminal, and a cathode of the photosensitive diode is connected to the reading control sub-circuit.

5. The pixel unit circuit according to claim 2, wherein the first voltage input terminal and the third voltage input terminal are a same voltage input terminal;

both the first voltage input terminal and the third voltage input terminal are high voltage input terminals;

the photosensitive sub-circuit comprises a photosensitive diode, a cathode of the photosensitive diode is connected to the third voltage input terminal, and an anode of the photosensitive diode is connected to the reading control sub-circuit.

6. The pixel unit circuit according to claim 2, wherein the first gate line and the second gate line are a same gate line.

7. The pixel unit circuit according to claim 2, wherein, the data writing sub-circuit comprises a first transistor and a capacitor, a gate electrode of the first transistor is connected to the first gate line, a first electrode of the first transistor is connected to the data line, a second electrode of the first transistor is connected to a gate electrode of the driving transistor; a first electrode plate of the capacitor is connected to the gate electrode of the driving transistor, and a second electrode plate of the capacitor is connected to the second electrode of the driving transistor;

the reading control sub-circuit comprises a second transistor, a gate electrode of the second transistor is connected to the second gate line, a first electrode of the second transistor is connected to the reading line, a second electrode of the second transistor is connected to the first electrode of the photosensitive sub-circuit.

8. The pixel unit circuit according to claim 1, wherein a quantity of the at least one sub-pixel sub-unit circuit comprised in the pixel unit circuit is at least two;

the pixel unit circuit further comprises a display control sub-circuit; the display control sub-circuit is configured to control the at least two sub-pixel sub-unit circuits comprised in the pixel unit circuit to emit light at different time periods.

9. A pixel circuit, comprising:

a plurality of pixel unit circuits according to claim 1, wherein the plurality of pixel unit circuits is arranged in a matrix including multiple rows and multiple columns.

10. The pixel circuit according to claim 9, wherein the at least two compensation signal lines comprise a second gate line and a reading line;

pixel compensation sub-unit circuits comprised in a same row of the multiple rows of pixel unit circuits in the plurality of pixel unit circuits are connected to a same second gate line;

pixel compensation sub-unit circuits comprised in a same column of the multiple columns of pixel unit circuits in the plurality of pixel unit circuits are connected to a same reading line.

11. A pixel circuit, comprising:

a plurality of pixel unit circuits according to claim 1, wherein the plurality of pixel unit circuits is arranged in a matrix including multiple rows and multiple columns; and the control circuit comprises a compensation control sub-circuit and a data driving sub-circuit connected to the compensation control sub-circuit;

wherein the compensation control sub-circuit is connected to the reading line through the multiplexer sub-circuit, the data driving sub-circuit is connected to the data line through the multiplexer sub-circuit;

the compensation control sub-circuit is configured to read an electrical signal in the reading line, compare a value of the electrical signal with a pre-determined electrical signal value, determine whether a voltage in the data line needs to be adjusted or not according to a result of the comparison; and in case that the voltage in the data line needs to be adjusted, the compensation control sub-circuit is configured to send a data voltage adjustment signal to the data driving sub-circuit so that the data driving sub-circuit obtains the data voltage adjustment signal;

the data driving sub-circuit is configured to adjust a data voltage to be outputted to the data line according the data voltage adjustment signal and obtain an adjusted data voltage, and send the adjusted data voltage to the at least one sub-pixel sub-circuit.

12. A method for driving the pixel unit circuit according to the claim 1, wherein each of the at least one sub-pixel sub-unit circuit comprised in the pixel unit circuit comprises a light emitting element, the pixel compensation sub-unit circuit comprises a reading control sub-circuit and a photosensitive sub-circuit configured to convert light emitted by the light emitting element to an electrical signal; a compensation control sub-circuit is connected to a data driving sub-circuit, the data driving sub-circuit is configured to supply a data voltage to a data line connected to each of the at least one sub-pixel sub-unit circuit; wherein a compensation time stage is provided between two display time stages, the compensation time stage comprises a reading time sub-stage corresponding to the pixel compensation sub-unit circuit, the method for driving the pixel unit circuit comprises:

obtaining a predetermined brightness corresponding to a predetermined data voltage according to a gamma curve of the at least one sub-pixel sub-unit circuit, and converting the predetermined brightness to a predetermined electrical signal value according to photoelectric conversion parameters of the photosensitive sub-circuit;

sensing, by the photosensitive circuit, light emitted from the light emitting element in the sub-pixel sub-unit circuit, and converting the light to an electrical signal corresponding to the light;

in the reading time sub-stage, controlling, by the reading control sub-circuit, the photosensitive sub-circuit to be connected to the reading line so that the electrical signal is transferred from the photosensitive sub-circuit to the compensation control sub-circuit through the reading line;

detecting, by the compensation control sub-circuit, a value of the electrical signal, comparing the value of the electrical signal with the predetermined electrical signal value, determining whether a data voltage in the data line needs to be adjusted or not according to a result of the comparison; and in case that the data voltage in the data line needs to be adjusted, sending, by the compensation control sub-circuit, a data voltage adjustment signal to the data driving sub-circuit so that the data driving sub-circuit adjusts the data voltage to be outputted to the data line and obtains an adjusted data voltage; and transmitting, by the data driving sub-circuit through the data line, the adjusted data voltage to one of the at least one sub-pixel sub-unit circuit connected to the data line.

13. The method according to claim 12, wherein the electrical signal comprises at least one of an electrical voltage signal, an electrical current signal or an electric charge signal;

the value of the electrical signal comprises at least one of an electrical voltage value, an electrical current value or an electric charge amount.

14. The method according to claim 12, wherein each of the at least one sub-pixel sub-unit circuit further comprises a data writing sub-pixel and a driving transistor the at least two display signal lines comprise a first gate line and a data line; the at least two compensation signal lines comprise a second gate line and a reading line; the data writing sub-circuit is connected to the first gate line, the data line and a gate electrode of the driving transistor; the reading control sub-circuit is connected to the second gate line, the reading line and a first terminal of the photosensitive sub-circuit; the first gate line and the second gate line are a same gate line; the method further comprises:

in one of the display time stages in which a voltage in the reading line is a low level, controlling, by the data writing sub-circuit under a control of the first gate line, a data voltage in the data line to be written into the gate electrode of the driving transistor, and controlling, by the reading control sub-circuit, the first terminal of the photosensitive sub-circuit to be connected to the reading line so that an electrical potential of the first terminal of the photosensitive sub-circuit is reset;

in the reading time sub-stage after the display time stage, controlling, by the reading control sub-circuit, the photosensitive sub-circuit to be connected to the reading line so that the electrical signal is transferred from the photosensitive sub-circuit to the compensation control sub-circuit through the reading line.

15. The method according to claim 12, wherein, in the reading time sub-stage after the display time stage, controlling, by the reading control sub-circuit, the photosensitive sub-circuit to be connected to the reading line so that the electrical signal is transferred from photosensitive sub-circuit to the compensation control sub-circuit through the reading line, specifically comprises:

in the reading time sub-stage, controlling, by the reading control sub-circuit, a first terminal of the photosensitive sub-circuit to be connected to the reading line so that the electrical signal is transferred from the photosensitive sub-circuit to the compensation control sub-circuit through the reading line.

16. The method according to claim 12, wherein, the at least one sub-pixel sub-unit circuit further comprises a data writing sub-circuit and a driving transistor the at least two display signal lines comprise a first gate line and the data line; the at least two compensation signal lines comprise a second gate line and the reading line; the data writing sub-circuit is connected to the first gate line, the data line and a gate electrode of the driving transistor; the reading control sub-circuit is connected to the second gate line, the reading line and a first terminal of the photosensitive circuit; the pixel unit circuit comprises a multiplexer circuit; the data line is connected to a first input terminal of the multiplexer sub-circuit; the reading line is connected to a second input terminal of the multiplexer sub-circuit; an output terminal of the multiplexer sub-circuit is connected to a control circuit outside the pixel unit circuit; the compensation control sub-circuit and the data driving sub-circuit are arranged in the control circuit; the compensation control sub-circuit is connected to the reading line through the multiplexer sub-circuit;

in the reading time sub-stage, controlling, by the reading control sub-circuit, the photosensitive sub-circuit to be connected to the reading line so that the electrical signal is transferred from the photosensitive sub-circuit to the compensation control sub-circuit through the reading line, comprises:

in the reading time sub-stage, controlling, by the multiplexer sub-circuit, the reading line to be connected to the control circuit, so that the electrical signal is transferred from the photosensitive sub-circuit to the compensation control sub-circuit in the control circuit through the reading line; and after the data driving sub-circuit obtains the adjusted data voltage, the method further comprises:

controlling, by the multiplexer sub-circuit, the reading line and the control circuit to be disconnected with each other, and controlling, by the multiplexer sub-circuit, the control circuit and the data line to be connected to each other, and transmitting, by the data driving sub-circuit, the adjusted data voltage to the at least one sub-pixel sub-unit circuit through the data line.

* * * * *